US010189292B2

(12) United States Patent
Prett et al.

(10) Patent No.: US 10,189,292 B2
(45) Date of Patent: Jan. 29, 2019

(54) METHOD FOR THE SURFACE APPLICATION OF A SECURITY DEVICE TO A SUBSTRATE

(71) Applicant: Crane & Co., Inc., Boston, MA (US)

(72) Inventors: Giles D. Prett, Dalton, MA (US); Manish Jain, Pittsfield, MA (US); Kraig M. Brigham, Lenox, MA (US)

(73) Assignee: Crane & Co., Inc., Boston, MA (US)

( * ) Notice: Subject to any disclaimer, the term of this patent is extended or adjusted under 35 U.S.C. 154(b) by 289 days.

(21) Appl. No.: 15/041,800

(22) Filed: Feb. 11, 2016

(65) Prior Publication Data

US 2016/0229215 A1 Aug. 11, 2016

Related U.S. Application Data

(60) Provisional application No. 62/114,699, filed on Feb. 11, 2015.

(51) Int. Cl.

| | |
|---|---|
| ***B42D 25/24*** | (2014.01) |
| ***D21H 21/48*** | (2006.01) |
| ***B42D 25/29*** | (2014.01) |
| ***B42D 25/333*** | (2014.01) |
| ***B42D 25/48*** | (2014.01) |

(Continued)

(52) U.S. Cl.

CPC ..... *B42D 25/24* (2014.10); *B42D 25/29* (2014.10); *B42D 25/333* (2014.10); *B42D 25/48* (2014.10); *D21H 21/40* (2013.01); *D21H 21/42* (2013.01); *D21H 21/48* (2013.01)

(58) Field of Classification Search

USPC ..... 162/140

See application file for complete search history.

(56) References Cited

U.S. PATENT DOCUMENTS

| | | | |
|---|---|---|---|
| 992,151 | A | 5/1911 | Berthon |
| 1,824,353 | A | 9/1931 | Jensen |

(Continued)

FOREIGN PATENT DOCUMENTS

| | | |
|---|---|---|
| AU | 2009278275 | 7/2012 |
| CA | 2741298 | 4/2010 |

(Continued)

OTHER PUBLICATIONS

Article: "Spherical Lenses" (Jan. 18, 2009); pp. 1-12; retrieved from the Internet: URL:http://www.physicsinsights.org/simple_optics_spherical_lenses-1.html.

(Continued)

*Primary Examiner* — Mark Halpern

(57) ABSTRACT

A method for applying a security device (e.g., a micro-optic security thread) to a fibrous web during manufacture is provided. By way of the inventive method, the security device is preferably applied onto the fibrous web at or near a couch roll or similar tool of a paper machine when the fibrous web constitutes a sufficiently consolidated, fully formed wet web. Papers made in accordance with the inventive method, when subjected to the Circulation Simulation Test, showed minimal damage at the paper/security device interface. Moreover, the surface-applied security devices showed acceptable levels of intaglio ink adhesion, and the papers had higher cross-direction (CD) tensile strength and much less show-through on opposing sides thereof.

26 Claims, 8 Drawing Sheets

(51) Int. Cl.
*D21H 21/40* (2006.01)
*D21H 21/42* (2006.01)

(56) References Cited

U.S. PATENT DOCUMENTS 1,849,036 A 3/1932 Ernst
1,942,841 A 1/1934 Shimizu
2,268,351 A 12/1941 Tanaka
2,355,902 A 8/1944 Berg
2,432,896 A 12/1947 Hotchner
2,888,855 A 6/1959 Tanaka
2,992,103 A 7/1961 Land et al.
3,122,853 A 3/1964 Koonz et al.
3,241,429 A 3/1966 Rice et al.
3,264,164 A 8/1966 Jerothe et al.
3,312,006 A 4/1967 Rowland
3,357,772 A 12/1967 Rowland
3,357,773 A 12/1967 Rowland
3,463,581 A 8/1969 Clay
3,609,035 A 9/1971 Ataka
3,643,361 A 2/1972 Eaves
3,704,068 A 11/1972 Waly
3,801,183 A 4/1974 Sevelin et al.
3,811,213 A 5/1974 Eaves
3,887,742 A 6/1975 Reinnagel
4,025,673 A 5/1977 Reinnagel
4,073,650 A 2/1978 Yevick
4,082,426 A 4/1978 Brown
4,185,191 A 1/1980 Stauffer
4,345,833 A 8/1982 Siegmund
4,417,784 A 11/1983 Knop et al.
4,498,736 A 2/1985 Griffin
4,507,349 A 3/1985 Fromson et al.
4,519,632 A 5/1985 Parkinson et al.
4,534,398 A 8/1985 Crane
4,634,220 A 1/1987 Hockert et al.
4,645,301 A 2/1987 Orensteen et al.
4,662,651 A 5/1987 Mowry, Jr.
4,688,894 A 8/1987 Hockert
4,691,993 A 9/1987 Porter et al.
4,756,972 A 7/1988 Kloosterboer et al.
4,765,656 A 8/1988 Becker et al.
4,814,594 A 3/1989 Drexler
4,892,336 A 1/1990 Kaule et al.
4,892,385 A 1/1990 Webster, Jr. et al.
4,920,039 A 4/1990 Fotland et al.
4,935,335 A 6/1990 Fotland
4,988,126 A 1/1991 Heckenkamp et al.
5,044,707 A 9/1991 Mallik
5,074,649 A 12/1991 Hamanaka
5,085,514 A 2/1992 Mallik et al.
5,135,262 A 8/1992 Smith et al.
5,142,383 A 8/1992 Mallik
5,211,424 A 5/1993 Bliss
5,215,864 A 6/1993 Laakmann
5,232,764 A 8/1993 Oshima
5,254,390 A 10/1993 Lu
5,282,650 A 2/1994 Smith et al.
5,359,454 A 10/1994 Steenblik et al.
5,384,861 A 1/1995 Mattson et al.
5,393,099 A 2/1995 D'Amato
5,393,590 A 2/1995 Caspari
5,413,839 A 5/1995 Chatwin et al.
5,433,807 A 7/1995 Heckenkamp et al.
5,438,928 A 8/1995 Chatwin et al.
5,442,482 A 8/1995 Johnson et al.
5,449,200 A 9/1995 Andric et al.
5,460,679 A 10/1995 Abdel-Kader
5,461,495 A 10/1995 Steenblik et al.
5,464,690 A 11/1995 Boswell
5,468,540 A 11/1995 Lu
5,479,507 A 12/1995 Anderson
5,492,370 A 2/1996 Chatwin et al.
5,503,902 A 4/1996 Steenblik et al.
5,538,753 A 7/1996 Antes et al.
5,543,942 A 8/1996 Mizuguchi et al.
5,555,476 A 9/1996 Suzuki et al.
5,567,276 A 10/1996 Boehm et al.
5,568,313 A 10/1996 Steenblik et al.
5,574,083 A 11/1996 Brown et al.
5,575,507 A 11/1996 Yamauchi et al.
5,598,281 A 1/1997 Zimmerman et al.
5,623,347 A 4/1997 Pizzanelli
5,623,368 A 4/1997 Calderini et al.
5,626,969 A 5/1997 Joson
5,631,039 A 5/1997 Knight et al.
5,639,126 A 6/1997 Dames et al.
5,642,226 A 6/1997 Rosenthal
5,643,678 A 7/1997 Boswell
5,670,003 A 9/1997 Boswell
5,670,096 A 9/1997 Lu
5,674,580 A 10/1997 Boswell
5,688,587 A 11/1997 Burchard et al.
5,695,346 A 12/1997 Sekiguchi et al.
5,712,731 A 1/1998 Drinkwater et al.
5,723,200 A 3/1998 Oshima et al.
5,731,064 A 3/1998 Süss
5,737,126 A 4/1998 Lawandy
5,753,349 A 5/1998 Boswell
5,759,683 A 6/1998 Boswell
5,763,349 A 6/1998 Zandona
5,783,017 A 7/1998 Boswell
5,783,275 A 7/1998 Mück et al.
5,800,907 A 9/1998 Yumoto
5,810,957 A 9/1998 Boswell
5,812,313 A 9/1998 Johansen et al.
5,886,798 A 3/1999 Staub et al.
5,933,276 A 8/1999 Magee
5,949,420 A 9/1999 Terlutter
5,995,638 A 11/1999 Amidror et al.
6,030,691 A 2/2000 Burchard et al.
6,036,230 A 3/2000 Farber
6,036,233 A 3/2000 Braun et al.
6,060,143 A 5/2000 Tompkin et al.
6,084,713 A 7/2000 Rosenthal
6,089,614 A 7/2000 Howland et al.
6,106,950 A 8/2000 Searle et al.
6,176,582 B1 1/2001 Grasnick
6,177,953 B1 1/2001 Vachette et al.
6,179,338 B1 1/2001 Bergmann et al.
6,195,150 B1 2/2001 Silverbrook
6,249,588 B1 6/2001 Amidror et al.
6,256,149 B1 7/2001 Rolfe
6,256,150 B1 7/2001 Rosenthal
6,283,509 B1 9/2001 Braun et al.
6,288,842 B1 9/2001 Florczak et al.
6,297,911 B1 10/2001 Nishikawa et al.
6,301,363 B1 10/2001 Mowry, Jr.
6,302,989 B1 10/2001 Kaule
6,328,342 B1 12/2001 Belousov et al.
6,329,040 B1 12/2001 Oshima et al.
6,329,987 B1 12/2001 Gottfried et al.
6,345,104 B1 2/2002 Rhoads
6,348,999 B1 2/2002 Summersgill et al.
6,350,036 B1 2/2002 Hannington et al.
6,369,947 B1 4/2002 Staub et al.
6,373,965 B1 4/2002 Liang
6,381,071 B1 4/2002 Dona et al.
6,404,555 B1 6/2002 Nishikawa
6,405,464 B1 6/2002 Gulkick, Jr. et al.
6,414,794 B1 7/2002 Rosenthal
6,424,467 B1 7/2002 Goggins
6,433,844 B2 8/2002 Li
6,450,540 B1 9/2002 Kim
6,467,810 B2 10/2002 Taylor et al.
6,473,238 B1 10/2002 Daniell
6,483,644 B1 11/2002 Gottfried et al.
6,500,526 B1 12/2002 Hannington
6,521,324 B1 2/2003 Debe et al.
6,542,646 B1 4/2003 Bar-Yona
6,558,009 B2 5/2003 Hannington et al.
6,587,276 B2 7/2003 Daniell
6,616,803 B1 9/2003 Isherwood et al.
6,618,201 B2 9/2003 Nishikawa et al.

(56) References Cited

U.S. PATENT DOCUMENTS 6,641,270 B2 11/2003 Hannington et al.
6,671,095 B2 12/2003 Summersgill et al.
6,712,399 B1 3/2004 Drinkwater et al.
6,721,101 B2 4/2004 Daniell
6,724,536 B2 4/2004 Magee
6,726,858 B2 4/2004 Andrews
6,751,024 B1 6/2004 Rosenthal
6,761,377 B2 7/2004 Taylor et al.
6,795,250 B2 9/2004 Johnson et al.
6,803,088 B2 10/2004 Kaminsky et al.
6,819,775 B2 11/2004 Amidror et al.
6,833,960 B1 12/2004 Scarbrough et al.
6,856,462 B1 2/2005 Scarbrough et al.
6,870,681 B1 3/2005 Magee
6,900,944 B2 5/2005 Tomczyk
6,926,764 B2 8/2005 Bleikolm et al.
6,935,756 B2 8/2005 Sewall et al.
7,030,997 B2 4/2006 Neureuther et al.
7,058,202 B2 6/2006 Amidror
7,068,434 B2 6/2006 Florczak et al.
7,114,750 B1 10/2006 Alasia et al.
7,194,105 B2 3/2007 Hersch et al.
7,246,824 B2 7/2007 Hudson
7,254,265 B2 8/2007 Naske et al.
7,255,911 B2 8/2007 Lutz et al.
7,288,320 B2 10/2007 Steenblik et al.
7,333,268 B2 2/2008 Steenblik et al.
7,336,422 B2 2/2008 Dunn et al.
7,359,120 B1 4/2008 Raymond et al.
7,372,631 B2 5/2008 Ozawa
7,389,939 B2 6/2008 Jones et al.
7,422,781 B2 9/2008 Gosselin
7,457,038 B2 11/2008 Dolgoff
7,457,039 B2 11/2008 Raymond et al.
7,468,842 B2 12/2008 Steenblik et al.
7,504,147 B2 3/2009 Hannington
7,545,567 B2 6/2009 Tomczyk
7,609,450 B2 10/2009 Niemuth
7,630,954 B2 12/2009 Adamczyk et al.
7,686,187 B2 3/2010 Pottish et al.
7,712,623 B2 5/2010 Wentz et al.
7,719,733 B2 5/2010 Schilling et al.
7,738,175 B2 6/2010 Steenblik et al.
7,744,002 B2 6/2010 Jones et al.
7,751,608 B2 7/2010 Hersch et al.
7,762,591 B2 7/2010 Schilling et al.
7,763,179 B2 7/2010 Levy et al.
7,812,935 B2 10/2010 Cowburn et al.
7,820,269 B2 10/2010 Staub et al.
7,830,627 B2 11/2010 Commander et al.
7,849,993 B2 12/2010 Finkenzeller et al.
3,027,093 A1 9/2011 Commander et al.
8,057,980 B2 11/2011 Dunn et al.
8,111,463 B2 2/2012 Endle et al.
8,149,511 B2 4/2012 Kaule et al.
8,241,732 B2 8/2012 Hansen et al.
8,284,492 B2 10/2012 Crane et al.
8,367,452 B2 2/2013 Soma et al.
8,514,492 B2 8/2013 Schilling et al.
8,528,941 B2 9/2013 Dörfler et al.
8,537,470 B2 9/2013 Endle et al.
8,557,369 B2 10/2013 Hoffmüller et al.
8,693,101 B2 4/2014 Tomczyk et al.
8,867,134 B2 10/2014 Steenblik et al.
8,908,276 B2 12/2014 Holmes
9,802,437 B2 10/2017 Holmes
2001/0048968 A1 12/2001 Cox et al.
2002/0014967 A1 2/2002 Crane et al.
2002/0114078 A1 8/2002 Halle et al.
2002/0167485 A1 11/2002 Hedrick
2002/0185857 A1 12/2002 Taylor et al.
2003/0031861 A1 2/2003 Reiter et al.
2003/0112523 A1 6/2003 Daniell
2003/0157211 A1 8/2003 Tsunetomo et al.
2003/0179364 A1 9/2003 Steenblik et al.
2003/0183695 A1 10/2003 Labrec et al.
2003/0228014 A1 12/2003 Alasia et al.
2003/0232179 A1 12/2003 Steenblik et al.
2003/0234294 A1 12/2003 Uchihiro et al.
2004/0020086 A1 2/2004 Hudson
2004/0022967 A1 2/2004 Lutz et al.
2004/0065743 A1* 4/2004 Doublet ..... B32B 38/1833 235/487
2004/0100707 A1 5/2004 Kay et al.
2004/0140665 A1 7/2004 Scarborough et al.
2004/0209049 A1 10/2004 Bak
2005/0094274 A1 5/2005 Souparis
2005/0104364 A1 5/2005 Keller et al.
2005/0161501 A1 7/2005 Giering et al.
2005/0180020 A1 8/2005 Steenblik et al.
2005/0247794 A1 11/2005 Jones et al.
2006/0003295 A1 1/2006 Hersch et al.
2006/0011449 A1 1/2006 Knoll
2006/0017979 A1 1/2006 Goggins
2006/0018021 A1 1/2006 Tomkins et al.
2006/0061267 A1 3/2006 Yamasaki et al.
2006/0227427 A1 10/2006 Dolgoff
2007/0058260 A1 3/2007 Steenblik et al.
2007/0092680 A1 4/2007 Chaffins et al.
2007/0164555 A1 7/2007 Mang et al.
2007/0183045 A1 8/2007 Schilling et al.
2007/0183047 A1 8/2007 Phillips et al.
2007/0273143 A1 11/2007 Crane et al.
2007/0284546 A1 12/2007 Ryzi et al.
2007/0291362 A1 12/2007 Hill et al.
2008/0130018 A1 6/2008 Steenblik et al.
2008/0143095 A1 6/2008 Isherwood et al.
2008/0160226 A1 7/2008 Kaule et al.
2008/0182084 A1 7/2008 Tompkin et al.
2009/0008923 A1 1/2009 Kaule et al.
2009/0061159 A1 3/2009 Staub et al.
2009/0243278 A1* 10/2009 Camus ..... D21H 21/48 283/72
2009/0261572 A1 10/2009 Bleikolm et al.
2009/0290221 A1 11/2009 Hansen et al.
2009/0310470 A1 12/2009 Yrjonen
2009/0315316 A1 12/2009 Staub et al.
2010/0001508 A1 1/2010 Tompkin et al.
2010/0018644 A1 1/2010 Sacks et al.
2010/0045024 A1 2/2010 Attner et al.
2010/0068459 A1 3/2010 Wang et al.
2010/0084851 A1 4/2010 Schilling
2010/0103528 A1 4/2010 Endle et al.
2010/0109317 A1 5/2010 Huffmuller et al.
2010/0177094 A1 7/2010 Kaule et al.
2010/0182221 A1 7/2010 Kaule et al.
2010/0194532 A1 8/2010 Kaule
2010/0208036 A1 8/2010 Kaule
2010/0277805 A1 11/2010 Schilling et al.
2010/0308571 A1 12/2010 Steenblik et al.
2010/0328922 A1 12/2010 Peters et al.
2011/0017498 A1 1/2011 Lauffer et al.
2011/0019283 A1 1/2011 Steenblik et al.
2011/0045255 A1 2/2011 Jones et al.
2011/0056638 A1* 3/2011 Rosset ..... D21F 11/06 162/109
2011/0179631 A1 7/2011 Gates et al.
2012/0019607 A1 1/2012 Dunn et al.
2012/0033305 A1 2/2012 Moon et al.
2012/0091703 A1 4/2012 Maguire et al.
2012/0098249 A1 4/2012 Rahm et al.
2012/0194916 A1 8/2012 Cape et al.
2012/0243744 A1 9/2012 Camus et al.
2013/0003354 A1 1/2013 Meis et al.
2013/0010048 A1 1/2013 Dunn et al.
2013/0038942 A1 2/2013 Holmes
2013/0044362 A1 2/2013 Commander et al.
2013/0154250 A1 6/2013 Dunn et al.
2013/0154251 A1 6/2013 Jolic
2014/0174306 A1 6/2014 Wening et al.
2014/0175785 A1 6/2014 Kaule et al.
2014/0353959 A1 12/2014 Lochbihler
2014/0367957 A1 12/2014 Jordan
2015/0152602 A1 6/2015 Blake et al.

(56) References Cited

U.S. PATENT DOCUMENTS

| | | | |
|---|---|---|---|
| 2016/0101643 | A1 | 4/2016 | Cape et al. |
| 2016/0176221 | A1 | 6/2016 | Holmes |
| 2016/0257159 | A1 | 9/2016 | Attner et al. |
| 2016/0325577 | A1 | 11/2016 | Jordan |
| 2017/0015129 | A1 | 1/2017 | Jordan |

FOREIGN PATENT DOCUMENTS

| | | |
|---|---|---|
| CN | 1102865 | 5/1995 |
| CN | 1126970 | 11/2003 |
| CN | 1950570 | 4/2007 |
| CN | 101678664 | 3/2010 |
| DE | 19804858 | 8/1999 |
| DE | 19932240 | 1/2001 |
| DE | 10100692 | 8/2004 |
| EP | 0090130 | 10/1983 |
| EP | 0092691 | 11/1983 |
| EP | 0118222 | 9/1984 |
| EP | 0156460 | 10/1985 |
| EP | 0203752 | 12/1986 |
| EP | 0253089 | 1/1988 |
| EP | 0318717 | 6/1989 |
| EP | 0415230 | 3/1991 |
| EP | 0319157 | 7/1992 |
| EP | 0801324 | 10/1997 |
| EP | 0887699 | 12/1998 |
| EP | 0930174 | 7/1999 |
| EP | 0997750 | 5/2000 |
| EP | 1356952 | 10/2003 |
| EP | 1002640 | 5/2004 |
| EP | 1538554 | 6/2005 |
| EP | 1354925 | 4/2006 |
| EP | 1659449 | 5/2006 |
| EP | 1743778 | 1/2007 |
| EP | 1801636 | 6/2007 |
| EP | 1876028 | 1/2008 |
| EP | 1897700 | 3/2008 |
| EP | 1931827 | 1/2009 |
| EP | 2335937 | 6/2011 |
| EP | 2338682 | 6/2011 |
| EP | 2162294 | 3/2012 |
| FR | 2803939 | 7/2001 |
| FR | 2952194 | 5/2011 |
| GB | 1095286 | 12/1967 |
| GB | 2103669 | 2/1983 |
| GB | 2168372 | 6/1986 |
| GB | 2227451 | 1/1990 |
| GB | 2362493 | 11/2001 |
| GB | 2395724 | 6/2004 |
| GB | 2433470 | 6/2007 |
| GB | 2490780 | 11/2012 |
| JP | 41-004953 | 3/1941 |
| JP | 46-022600 | 6/1971 |
| JP | 04-234699 | 8/1992 |
| JP | H05-508119 | 11/1993 |
| JP | 10-035083 | 2/1998 |
| JP | 10-039108 | 2/1998 |
| JP | 11-501590 | 2/1999 |
| JP | 11-189000 | 7/1999 |
| JP | 2000-056103 | 2/2000 |
| JP | 2000-233563 | 8/2000 |
| JP | 2000-256994 | 9/2000 |
| JP | 2001-055000 | 2/2001 |
| JP | 2001-516899 | 10/2001 |
| JP | 2001-324949 | 11/2001 |
| JP | 2003-039583 | 2/2003 |
| JP | 2003-165289 | 6/2003 |
| JP | 2003-528349 | 9/2003 |
| JP | 2003-326876 | 11/2003 |
| JP | 2004-262144 | 9/2004 |
| JP | 2004-317636 | 11/2004 |
| JP | 2005-193501 | 7/2005 |
| JP | 2009-274293 | 11/2009 |
| JP | 2011-502811 | 1/2011 |
| KR | 10-0194536 | 6/1999 |
| KR | 2002170350000 | 3/2001 |
| KR | 2003119050000 | 5/2003 |
| KR | 1005443000000 | 1/2006 |
| KR | 1005613210000 | 3/2006 |
| KR | 10-2008-0048578 | 6/2008 |
| RU | 2111125 | 5/1998 |
| RU | 2245566 | 1/2005 |
| RU | 2010101854 | 7/2011 |
| TW | 575740 | 2/2004 |
| WO | WO 1992/008998 | 5/1992 |
| WO | WO 1992/019994 | 11/1992 |
| WO | WO 1993/024332 | 12/1993 |
| WO | WO 1996/035971 | 11/1996 |
| WO | WO 1997/019820 | 6/1997 |
| WO | WO 1997/044769 | 11/1997 |
| WO | WO 1998/013211 | 4/1998 |
| WO | WO 1998/015418 | 4/1998 |
| WO | WO 1998/026373 | 6/1998 |
| WO | WO 1999/014725 | 3/1999 |
| WO | WO 1999/023513 | 5/1999 |
| WO | WO 1999/026793 | 6/1999 |
| WO | WO 1999/066356 | 12/1999 |
| WO | WO 2001/007268 | 2/2001 |
| WO | WO 2001/011591 | 2/2001 |
| WO | WO 2001/039138 | 5/2001 |
| WO | WO 2001/053113 | 7/2001 |
| WO | WO 2001/063341 | 8/2001 |
| WO | WO 2001/071410 | 9/2001 |
| WO | WO 2002/040291 | 5/2002 |
| WO | WO 2002/043012 | 5/2002 |
| WO | WO 2002/101669 | 12/2002 |
| WO | WO 2003/005075 | 1/2003 |
| WO | WO 2003/007276 | 1/2003 |
| WO | WO 2003/022598 | 3/2003 |
| WO | WO 2003/053713 | 7/2003 |
| WO | WO 2003/061980 | 7/2003 |
| WO | WO 2003/061983 | 7/2003 |
| WO | WO 2003/082598 | 10/2003 |
| WO | WO 2003/098188 | 11/2003 |
| WO | WO 2004/022355 | 3/2004 |
| WO | WO 2004/036507 | 4/2004 |
| WO | WO 2004/087430 | 10/2004 |
| WO | WO 2005/106601 | 11/2005 |
| WO | WO 2006/029744 | 3/2006 |
| WO | WO 2007/076952 | 7/2007 |
| WO | WO 2007/133613 | 11/2007 |
| WO | WO 2009/000527 | 12/2008 |
| WO | WO 2009/000528 | 12/2008 |
| WO | WO 2009/000529 | 12/2008 |
| WO | WO 2009/000530 | 12/2008 |
| WO | WO 2009/118946 | 10/2009 |
| WO | WO 2009/121784 | 10/2009 |
| WO | WO 2010/015383 | 2/2010 |
| WO | WO 2010/094691 | 8/2010 |
| WO | WO 2010/099571 | 9/2010 |
| WO | WO 2010/136339 | 12/2010 |
| WO | WO 2011/015384 | 2/2011 |
| WO | WO 2011/019912 | 2/2011 |
| WO | WO 2011/044704 | 4/2011 |
| WO | WO 2011/051669 | 5/2011 |
| WO | WO 2011/122943 | 5/2011 |
| WO | WO 2012/027779 | 5/2011 |
| WO | WO 2012/103441 | 8/2011 |
| WO | WO 2011/107793 | 9/2011 |
| WO | WO 2013/028534 | 2/2013 |
| WO | WO 2013/093848 | 6/2013 |
| WO | WO 2013/098513 | 7/2013 |

OTHER PUBLICATIONS

Drinkwater, K. John, et al., "Development and applications of Diffractive Optical Security Devices for Banknotes and High Value Documents", Optical Security and Counterfeit Deterrence Techniques III, 2000, pp. 66-77, SPIE vol. 3973, San Jose, CA.

Fletcher, D.A., et al., "Near-field infrared imaging with a microfabricated solid immersion lens", Applied Physics Letters, Oct. 2, 2000, pp. 2109-2111, vol. 77, No. 14.

(56) References Cited

OTHER PUBLICATIONS

Gale, M. T., et al., Chapter 6—Replication, Micro Optics: Elements, Systems and Applications, 1997, pp. 153-177.
Hardwick, Bruce and Ghioghiu Ana, "Guardian Substrate As an Optical Medium for Security Devices", Optical Security and Counterfeit Deterrence Techniques III, 2000, pp. 176-179, SPIE vol. 3973, San Jose, CA.
Hutley, M.C., et al., "The Moiré Magnifier", Pure Appl. Opt. 3, 1994, pp. 133-142, IOP Publishing Ltd., UK.
Hutley, M.C., "Integral Photography, Superlenses and the Moiré Magnifier", European Optical Society, 1993, pp. 72-75, vol. 2, UK.
Hutley, M., et al., "Microlens Arrays", Physics World, Jul. 1991, pp. 27-32.
Kamal, H., et al., "Properties of Moiré Magnifiers", Opt. Eng., Nov. 1998, pp. 3007-3014, vol. 37, No. 11.
Leech, Patrick W., et al., Printing via hot embossing of optically variable images in thermoplastic acrylic lacquer, Microelectronic Engineering, 2006, pp. 1961-1965, vol. 83, No. 10, Elsevier Publishers BV, Amsterdam, NL.
Lippmann, G., "Photgraphie—Épreuves Réversibles, Photographies Intégrals", Académie des Sciences, 1908, pp. 446-451, vol. 146, Paris.
Liu, S., et al., "Artistic Effect and Application of Moiré Patterns in Security Holograms", Applied Optics, Aug. 1995, pp. 4700-4702, vol. 34, No. 22.
Phillips, Roger W., et al., Security Enhancement of Holograms with Interference Coatings, Optical Security and Counterfeit Deterrence Techniques III, 2000, pp. 304-316, SPIE vol. 3973, San Jose, CA.
Steenblik, Richard A., et al., UNISON Micro-optic Security Film, Optical Security and Counterfeit Deterrence Techniques V, 2004, pp. 321-327, SPIE vol. 5310, San Jose, CA.
Van Renesse, Rudolf L., Optical Document Security, 1994, Artech House Inc., Norwood, MA.
Van Renesse, Rudolf L., Optical Document Security, 1998, 2nd edition, pp. 232-235, 240-241 and 320-321, Artech House Inc., Norwood, MA (ISBN 0-89006-982-4).
Van Renesse, Rudolf L., Optical Document Security, 2005, 3rd edition, pp. 62-169, Artech House Inc., Norwood, MA (ISBN 1-58053-258-6).
Wolpert, Gary R., Design and development of an effective optical variable device based security system Incorporating additional synergistic security technologies, Optical Security and Counterfeit Deterrence Techniques III, 2000, pp. 55-61, SPIE vol. 3973, San Jose, CA.
Zhang, X., et al., "Concealed Holographic Coding for Security Applications by Using a Moiré Technique", Applied Optics, Nov. 1997, pp. 8096-8097, vol. 36, No. 31.
Amidror, "A Generalized Fourier-Based Method for the Analysis of 2D Moiré Envelope-Forms in Screen Superpositions", Journal of Modern Optics (London, GB), vol. 41, No. 9, Sep. 1, 1994, pp. 1837-1862, ISSN: 0950-0340.
Dunn, et al., "Three-Dimensional Virtual Images for Security Applications", Optical Security and Counterfeit Deterrence Techniques V, (published Jun. 3, 2004), Proc. SPIE 5310.
Muke, "Embossing of Optical Document Security Devices", Optical Security and Counterfeit Deterrence Techniques V, (published Jun. 3, 2004), Proc. SPIE 5310.

* cited by examiner

Table 1

Table 2

METHOD FOR THE SURFACE APPLICATION OF A SECURITY DEVICE TO A SUBSTRATE

RELATED APPLICATION

This application claims priority to U.S. Provisional Patent Application Ser. No. 62/114,699, filed Feb. 11, 2015, which is incorporated herein in its entirety by reference.

TECHNICAL FIELD

The present invention generally relates to a sheet material having a surface applied security device and to a method for preparing such a sheet material. More particularly, the invention relates to the surface application of the security device to a sheet material by introducing the security device to the fibrous web during a wet stage of a paper manufacturing process where the fibrous web is sufficiently consolidated; such as when the water and/or moisture content of the fibrous web is less than 98% by weight, based on the total weight of the fibrous web. The present invention also relates to a document made from the resulting fibrous sheet material.

BACKGROUND

Security devices in the form of stripes, bands, threads, or ribbons are used extensively in security and value documents, providing visual and/or mechanical means for verifying the authenticity of these documents. These security devices may be either fully embedded or partially embedded in the documents, or mounted on a surface thereof.

Security devices that are at least partially embedded can be applied to a forming fibrous web by introducing the security device into the fibrous web during a wet stage of a paper manufacturing process. However, introduction of security devices into the fibrous web in this stage, while suitable for embedded and partially embedded security devices, have heretofore been impractical for surface applied security devices since the resulting sheet material or document would be susceptible to reduced durability. At this stage, the composition of the forming fibrous web is constituted of pulp or fibers and water and/or other moisture. The fibrous web being substantially wet is such that the amount of pulp or fiber ranges from about 0.2 to about 2.0 percent (%) by weight pulp or fiber, while the amount of water or moisture ranges from about 99.8 to about 98.0% by weight moisture or water. For example, in a wet stage application, security devices can be introduced onto or into a forming fibrous web at the wet end of a Fourdrinier or twin wire paper machine, or against a fibrous web forming cylinder in a cylinder paper machine before that portion of the forming cylinder is immersed in pulp or furnish.

It has been found that during the wet stage introduction of the security device to the forming fibrous web, some of the fibers are displaced as they flow around the security device as it is pressed into the fibrous web. This results in displacement of an amount of fibers, from a sub-region (i.e., a region of the fibrous web located under or beneath the security device) and hinge areas (i.e., regions of the fibrous web located next to edges or sides of the security device) that is enough to affect the interaction of the security device with the fibrous web or with the substrate of the resulting sheet material or document. The resulting concentration of fibers in the sub-region and hinge areas is less than the concentration of fibers in the bulk region. This results in weak connective interaction at the interface of the security device and the substrate of the sheet material or document and in particular results in weak connective interaction at the interfacing surface and/or edges of the security device. During use or circulation of resulting documents, these weak regions produce tears in the sheet materials or documents along the interfacing edges between the security device and the substrate or produce a hinge effect (i.e., separated regions between interfacing edges). Moreover, the document tends to demonstrate backside show-through; that is, the applied security device when applied on one side of the fibrous web will produce a shadow effect that is observable from an opposing side of the fibrous web, any resulting fibrous sheet material or any resulting document. This often requires the use of a backside camouflage coating to address the problem. It has also been observed that said resulting sheet material or document demonstrates a reduction in cross-direction (CD) tensile strength.

One alternative for obtaining a surface applied security device is to apply the security device to a surface of a fully formed fibrous substrate. However, application to a fully formed fibrous substrate is accompanied by other substantial limitations. For example, this limits the thickness range of the security device that can be used. Generally, surface application is limited to the very thinnest of security devices, less than 15 microns. Thicker security devices are generally excluded from such applications at least in part because the resulting caliper differential on a resulting sheet material affects downstream processing. As used herein, the term "caliper differential" refers to the difference in height between an upper surface of the security device and an upper surface of the immediate adjoining bulk-region of the fibrous sheet material. Due to the caliper differential produced with thicker security devices that are introduced either in a dry stage of the paper manufacturing process or in a post application process, downstream processes such as winding, sheeting, stacking, cutting and processing through ATMs are impacted in terms of time and costs. Significantly, stacks produced this way are not press-ready or print ready.

In view of the above, there remains a need for improved sheet materials with surface applied security devices regardless of thickness and for improved processes that can produce these sheet materials.

SUMMARY OF THE INVENTION

The present invention addresses at least one of the above needs by providing a method for the surface application of a security device to a fibrous sheet material or document by introducing the security device to a forming fibrous web during a wet stage of paper manufacturing. The method comprises introducing a security device onto or into a forming fibrous web during a wet stage of the paper manufacturing process where the fibrous web is sufficiently consolidated. In one embodiment, the fibrous web is sufficiently consolidated when the fibrous web has a water or moisture content of less than 98% by weight, based on the total weight of the fibrous web. Preferably, the fibrous web is sufficiently consolidated when the fibrous web is at or near a couch roll or similar tool of a paper machine. The present invention also provides a fibrous sheet material, produced by the above process and a resulting document comprising the fibrous sheet material. The fibrous sheet material has opposing surfaces, on a fibrous substrate, at least one recess in one surface thereof, a fibrous sub-region disposed under or beneath the recess, and a fibrous bulk-region disposed next to the recess and the sub-region; a surface applied security device disposed in the recess; and an interface between the surface applied security device and the one surface; wherein there are fibers in the fibrous sub-region and in the fibrous bulk-region that are present in substantially equivalent amounts.

Surprisingly, it has been found that the surface applied security device can be introduced during a wet stage where the fibrous web is sufficiently consolidated as, for example, a fully formed wet web. By introducing the security device at this wet stage of the paper manufacturing process, the security device can be adequately forced into the fibrous web to further consolidate the fibers in the sub-region rather than displacing them. This in turn helps in providing increased connective interaction between the fibers and the surface applied security device. As a result, at least one of durability, ink adhesion, cross-directional (CD) tensile strength, and backside show-through is improved. These surprising advantages avoid the requirement for further processing steps to improve ink adhesion, improve tensile strength or camouflage backside show-through. Moreover, because the security device is introduced during a wet stage where the fibrous web is sufficiently consolidated, it becomes possible to force the security device into the fibrous web thereby enabling the use of thicker security devices, since their caliper differential can be substantially reduced. The resulting caliper differential thereby has less effect on downstream processes.

By way of the methods provided herein, Applicant also surprisingly found that the surface applied security devices could be applied in register with at least one other feature in the fibrous web, the fibrous sheet material or a resulting document. Moreover, because the security device is introduced during the wet stage of the fibrous web manufacturing process, it is possible to adjust the registration during the paper manufacturing process. Accordingly, further processing steps are avoided that would otherwise be required to correct misalignment of the security device with the other features. Introducing the security device in a continuous manner also avoids the requirement for a carrier substrate, since the security device can be cut/punched and introduced to the fibrous web with a single intro-device. As used herein, the term "intro-device" refers to a device used for cutting/punching and also introducing the security device to the fibrous web during the wet stage. Suitable intro-device is described further herein.

Those of ordinary skill in the art will be able to discern other features and advantages of the invention by following the detailed description and drawings. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting. Moreover, all ranges explicitly recited herein also implicitly cover all sub-ranges.

BRIEF DESCRIPTION OF THE DRAWINGS

The present disclosure may be better understood with reference to the following drawings. Components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications and equivalents.

Particular features of the disclosed invention are illustrated by reference to the accompanying drawings in which.

DETAILED DESCRIPTION OF THE INVENTION

Figure 1:
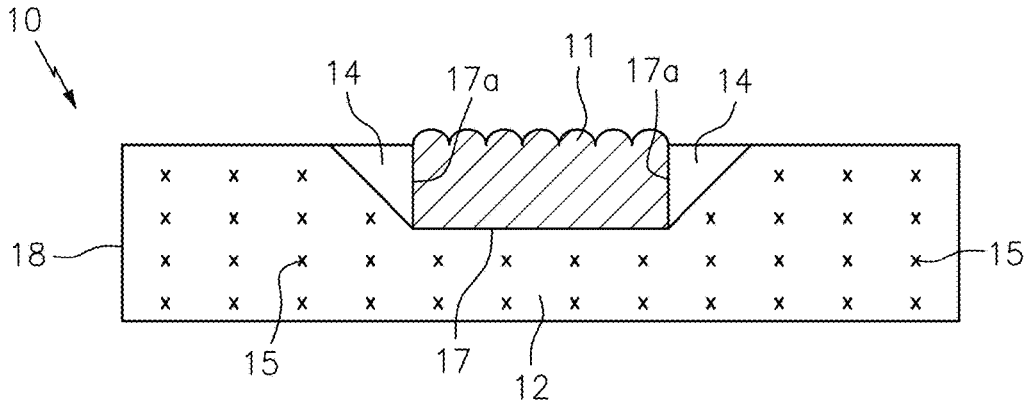
FIG. 1 (PRIOR ART)
FIG. 1 is a cross-sectional side view of a fibrous sheet material produced by introducing the security device into a fibrous web during a wet stage of paper manufacturing where the fibrous web is not sufficiently consolidated.

The invention will be further understood by the following details, which are provided as descriptions of certain exemplary embodiments of the claimed invention.

By way of the method of the present invention a fibrous sheet material comprising a surface applied security device is provided. In a first aspect of the invention, a method is provided for the surface application of a security device to a fibrous sheet material. The method comprises, introducing the security device into or onto a fibrous web during paper manufacturing. By introducing the security document during the paper manufacturing process, known processing steps are uninterrupted and additional processing steps are eliminated. Moreover, by introducing the security device during a wet stage of the paper manufacturing process, security devices thicker than those that could be applied in a dry stage of paper manufacturing, can hereby be applied.

In one embodiment, the method further comprises further consolidating the fibers in the sub-region. To further consolidate the fibers in the sub-region, the surface applied security device is pressed into the sufficiently consolidated fibrous web. The fibers densify in this region such that although the volume of the sub-region is reduced, the amount of fibers in this region are not displaced; at least not in any significant amounts.

As used herein, the term "sufficiently consolidated" will be understood, relative to the present disclosure, by those of ordinary skill in the art, to mean that the fibrous web is in a fully formed wet web state. In this wet web stage, the fibrous web comprises less than 98% water and/or moisture. Accordingly, the fibrous web comprises greater than 2% fiber and/or pulp. In another embodiment, the fibrous web comprises less than 95% water and/or moisture with the remaining 5% of constituents being fiber and/or pulp. In a more preferred embodiment, the water and/or moisture in the fibrous web ranges from about 60% to less than 98%, or from about 60% to about 95%. Applicant has found that a water and/or moisture content above 98% results in displacement of fibers when the security device is introduced. Significant displacement of the fibers, especially in a sub-region of the substrate, results in weak interactions between the security device and the fibers in the substrate. Particularly, the displacement of fibers reduces the durability and strength of the substrate and reduces the camouflaging effect provided in the sub-region and in the hinge area. As noted herein, these weak interactions, especially at the interfacing edges of the security device, results in the problems identified above. Correspondingly, it has also been found that where the fibrous web has less than 60% water and/or moisture, introduction of the security device during the paper manufacturing process does not sufficiently allow the recessing of the security device to accommodate thicker security devices while still maintaining a low caliper differential. Moreover, at below 60% water and/or moisture the fibers in the sub-region do not further consolidate enough to secure the fibers near the interfacing edges of the security device. As used herein, the term "recessing" refers to the pressing of the security device into the fibrous web to form a relief/recess in the substrate surface of the fibrous sheet material such that at least a portion of the height of the security device is recessed below the surface height of the bulk region while a top or upper surface area of the security device remains exposed.

The wet stage, as defined above, can be adjusted to be at various locations along a paper manufacturing machine and the present invention contemplates all of those possibilities. However, in a preferred embodiment the security device is applied into or onto a forming fibrous web during a wet stage of the paper manufacturing process, such as for example, at or near a couch roll or similar tool of a paper machine when the fibrous web constitutes a sufficiently consolidated, or fully formed wet web (i.e., having a moisture or water level of less than 98% by weight of the fibrous web, preferably from about 60% to less than 98% by weight of the fibrous web; or more preferably from about 60% to about 95% by weight of the fibrous web; or from about 60% to about 90% by weight of the fibrous web, based on the total weight of the fibrous web). Suction boxes are typically located right before the couch roll to remove as much moisture as possible before the web leaves the wet end of the machine so as to minimize the burden on the machine's dryer section. Similarly, upon leaving the cylinder part of the cylinder paper machine (and after the couch roll), the fibrous web will preferably be made up of from about 75% to about 95% water and/or moisture and from about 5% to about 25% pulp or fiber.

While several stages of paper manufacture on a Fourdrinier paper machine are contemplated as providing sufficient consolidation (as defined herein) of the fibrous web, in a preferred embodiment the stage of paper manufacture where the security device is introduced to the fibrous web is directly after the wet line and before the couch roll. This is the point at which there is no more surface water apparent on an upper side of the fibrous web. In an alternative embodiment, the security device is introduced to the fibrous web on or before a vacuum box in the wet end, which advantageously helps set the device into the web. Preferably, the security device is placed directly to the face of the fibrous web via a delivery wheel, a roller or a contacting shoe.

In one embodiment, upon moving past or further beyond the couch roll the fibrous web is in a state of being a fully formed web with surface applied security device as it proceeds to the dry end of the paper machine, which consists of both the press section and the dryer section.

In the press section of both types of paper machines, water and/or moisture is removed by compressing the wet paper between rollers and felts to reduce the water and/or moisture content to a desired level. Applicant has surprisingly found that compression of the fully formed wet web with surface applied security device causes fibers in the sub-region (i.e., the area of the fibrous web that is below or beneath the introduced security device) to be further consolidated as they are densified instead of displaced. As a result, the strength characteristics of the resulting fibrous sheet material or resulting document as well as backside opaqueness, which provides camouflaging of the security device to reduce backside show-through, are improved.

Security devices of the present invention may be of various thicknesses. However, it has been found that the present inventive process advantageously allows the surface application of security devices that are on the thicker end of the thickness spectrum. In one embodiment, the security devices are of thicknesses of up to 100 microns (μm). In another embodiment, the security device has a thickness ranging from 5 to 75 μm or more preferably, from 10 to 50 μm. The width of the security device is limited only by the width of the fibrous sheet material. In a preferred embodiment, the width ranges from 0.25 to 20 millimeters (mm); more preferably from 0.5 to 15 mm.

By introducing the security device during a wet stage of paper manufacturing, these security devices can be pressed into the fibrous web to produce a recess in the surface of the resulting fibrous sheet material. The resulting fibrous sheet material comprises a surface applied security device, which has a caliper differential that does not result in the disadvantages identified above. As used herein, the term "caliper differential" refers to the difference in height between an upper surface of the security device and an upper surface of the immediate adjoining bulk-region of the fibrous sheet material. The caliper differential can be negative or positive, or zero. A negative caliper differential is provided when the height of the upper surface of the immediate adjoining bulk-region is greater than the height of the upper surface of the security device. Alternatively, a positive caliper differential is provided when the height of the upper surface of the security device is greater than the height of the upper surface of the immediate adjoining bulk region. In one embodiment, the caliper differential is expressed relative to the thickness of the security device. In this embodiment, the absolute value of the caliper differential ranges from 0% to about 80% of the thickness of the security device.

In one embodiment, the caliper differential ranges from −10 to about 50 μm. More preferably, the caliper differential ranges from −5 to 30 μm; or from 0 to 25 μm.

In certain embodiments, the device is sufficiently thick such that pressing of the security device into the fibrous wet web results is a negative caliper differential (i.e., the thickness or height of the security device is less than the thickness or height of the bulk region). In such embodiments, caliper differential is best characterized by a reference to the absolute value of the caliper differential relative to the thickness of the security device. For example, in one embodiment the thickness of the security device is less than 25 μm such that when the security device is pressed into the fibrous web the absolute value of the caliper differential of the surface applied security device ranges from 0% to about 50%; more preferably from 0% to about 30%; even more preferably from about 0% to about 10% of the thickness of the security device. In one other embodiment, the thickness of the security device is again less than 25 μm such that further consolidation of the sub-region by pressing the security device into the fibrous web, produces a caliper differential ranging from −10 to 15 μm; preferably −5 to 10 μm.

Alternatively, in one embodiment the thickness of the security device is greater than 25 μm such that further consolidation of the sub-region by pressing the security device into the fibrous web produces a caliper differential ranging from −10 to 50 μm; preferably from −5 to 25 μm or from 0 to 15 μm. In one other embodiment where the security device also has a thickness of greater than 25 μm, the absolute value of the caliper differential relative to the thickness of the security device ranges from 0% to about 50%. Preferably, the absolute value of the caliper differential ranges from 0% to about 20% of the thickness of the security device.

A "couch roll" will be understood by those of ordinary skill in the art as a guide or turning roll for a Fourdrinier wire on a Fourdrinier paper machine, positioned where the paper web leaves the wire (i.e., the wet end or paper forming section) and the wire returns to the breast roll. The couch roll serves the same purpose on a cylinder paper machine where the Fourdrinier wire part has been replaced by a cylinder part. Specifically, as the web leaves the cylinder part and travels toward the couch roll, the couch roll guides and turns the web.

Although it is also contemplated that the entire fibrous web has a uniform consistency with regards to the water and/or moisture content and fiber content, it is also within the scope of the present invention that the fibrous web is non-uniformly sufficiently consolidated. For example, in one embodiment, the fibrous web is only sufficiently consolidated at or along a point of introduction. As used herein, the "point of introduction" refers to the region at or along the fibrous web that is at least partially covered by the security device. In another embodiment, the fibrous web is only partially sufficiently consolidated or is sufficiently consolidated in a gradient or matrix pattern, such that at the point of introduction, the fibers are not significantly dispersed to lead to the identified disadvantages. A sufficiently consolidated gradient or matrix pattern can be provided, for example, by selective vacuuming at locations along the forming fibrous web. Alternatively, in one embodiment, the moisture content is removed in a gradient or matrix pattern by applying a radiation source (i.e., heat) to remove top-surface water at selected locations along the forming fibrous web.

Introduction of the security device to the fibrous web forms an interface between the security device and the substrate fibrous web, the resulting fibrous sheet material or the resulting document. The term "interface" as used herein can be formed by either direct or indirect contact between the security device and the substrate. Where the interface is direct, the security device is in direct contact with the fibers in the substrate. However, it is contemplated that the security device forms an indirect interface along some or all bottom and side surfaces with the substrate. For example, the interface may comprise other materials between the security device and the substrate. While various materials are contemplated, further fibrous or polymeric materials, for example, monocomponent and/or multicomponent fibers obtained from natural sources such as vegetative sources, or spun from polymer melt compositions, etc., alone or in combination, are particularly suitable. Moreover adhesive materials are preferred for forming the indirect interface. Activatable adhesives may be used to anchor or bond the security device onto or within the fibrous web's recessed surface. Suitable adhesives are not limited and include, but are not limited to, water-, heat- and/or pressure-activating adhesives that activate in a dryer section of the paper machine, where temperatures reach between 100° C. and 160° C. These coatings may be applied in the form of solvent-based polymer solutions or aqueous solutions or dispersions. Suitable dispersions are selected from the group of acrylic resin dispersions, epoxy resin dispersions, natural latex dispersions, polyurethane resin dispersions, polyvinyl acetate resin dispersions, polyvinyl alcohol resin dispersions, urea formaldehyde resin dispersions, vinyl acetate resin dispersions, ethylene vinyl acetate resin dispersions, ethylene vinyl alcohol resin dispersions, polyester resin dispersions, and mixtures thereof. Upon moving past the couch roll, the fully formed wet web with surface applied security device proceeds to the dry end of the paper machine, which consists of both the press section and the dryer section. The adhesive may alternatively form part of the security device and in such embodiments have a thickness ranging from 5 to about 50 μm; preferably from 5 to about 20 μm.

Security devices suitable for the present invention include those generally used in the art by those of ordinary skill to provide security against forgery or counterfeiting. The security devices may be those suitable for alternatively or additionally applying aesthetic characteristics to a substrate. Suitable security devices may display information that is humanly perceivable either directly or with the aid of a device or may display information that is additionally or alternatively perceivable by a machine. The security device may employ one or more of the following features: demetalized or selectively metalized, magnetic, combined magnetic and metallic, or embossed regions or layers, color changing coatings made up of color shift, iridescent, liquid crystal, photochromic and/or thermochromic materials, coatings of luminescent and/or magnetic materials, holographic and/or diffractive security features, and micro-optic security features. In a preferred embodiment, the security device provides security such that a security or value document can be readily authenticated. In one embodiment the security device comprises an array of focusing elements and an array of image icons where the array of focusing elements and image icons are arranged such that one or more synthetic images are provided. Focusing elements suitable here include both lenticular lenses and non-cylindrical lenses (i.e., micro-lenses).

In an exemplary embodiment, the security device is a micro-lens based security device. Such devices generally comprise (a) a light-transmitting polymeric substrate, (b) an arrangement of micro-sized image icons located on or within the polymeric substrate, and (c) an arrangement of focusing elements (e.g., microlenses). The image icon and focusing element arrangements are configured such that when the arrangement of image icons is viewed through the arrangement of focusing elements, one or more synthetic images are projected. These projected images may show a number of different optical effects. Material constructions capable of presenting such effects are described in U.S. Pat. No. 7,333,268 to Steenblik et al., U.S. Pat. No. 7,468,842 to Steenblik et al., U.S. Pat. No. 7,738,175 to Steenblik et al., U.S. Pat. No. 7,830,627 to Commander et al., U.S. Pat. No. 8,149,511 to Kaule et al.; U.S. Pat. No. 8,878,844 to Kaule et al.; U.S. Pat. No. 8,786,521 to Kaule et al.; European Patent No. 2162294 to Kaule et al.; and European Patent Application No. 08759342.2 (or European Publication No. 2164713) to Kaule. These references are hereby incorporated in their entirety.

In a preferred embodiment, the security device that is being surface applied by the present inventive method includes, but is not limited to, micro-optic security devices such as the MOTION™ micro-optic security device, which is described in, for example, U.S. Pat. No. 7,333,268, the RAPID™ micro-optic security device, holographic security devices (e.g., metalized holographic devices). These devices are available from Crane Currency US, LLC of Massachusetts, USA. Other suitable devices include, but are not limited to optically variable devices (OVDs) such as the KINEGRAM™ optical data carrier, and color-shift security devices.

While the security device may be presented in various forms to be introduced to the fibrous web, it has been found most advantageous to provide the security device in the form of a continuous web. By providing the security device in the form of a continuous web, it has been found that the security device can be introduced to the fibrous web in a continuous manner. The continuous web is then sectioned or divided up into a plurality of discontinuous security devices. The sectioning of the continuous web into discontinuous security devices can be accomplished by various cutting and/or punching methods. In a preferred embodiment, the method is an in-line application process of the plurality of discontinuous security devices, without the use of a carrier film, to the fibrous web during manufacture on a paper machine. This method comprises providing the security device in the form of a continuous web; cutting or punching the continuous web in a continuous manner to form the discontinuous security devices, each having a desired shape and size; and then applying the discontinuous security devices in a continuous manner onto the fibrous web during paper manufacturing.

It is contemplated herein that additional security devices may be applied to the fibrous sheet material; either by surface application, partial embedment or total embedment. For example, in one embodiment, an additional security device is applied to the surface of the fibrous sheet material. Said additional device may be introduced to the fibrous web before the surface applied security device is introduced or applied after the surface applied security device is introduced. The additional security device may be different from or similar to the surface applied security device. For example, in one embodiment when one of the discontinuous security devices has a thickness of 25 μm or less, it is contemplated that it is introduced to the fibrous web when the moisture content is less than 60%; preferably ranges from about 90% to 0% by weight. For example, the security device is introduced to the fibrous web as it travels through the paper machine between the first dryer section and the size press and optionally rewetted to increase the water and/or moisture content to between about 4% and about 7%.

The security devices may take various sizes, shapes, or colors. For instance, it is contemplated that the security device, in the form of the discontinuous security device, takes the non-limiting form of a stripe, a band, a thread, a ribbon or a patch. These devices may be from about 2 to about 25 millimeters (mm) (preferably, from about 6 to about 12 mm) in total width, and from about 10 to about 50 microns (preferably, from about 20 to about 40 microns) in total thickness. In a preferred embodiment, the security device is a stripe or patch. A "stripe," as used herein, refers to a security device having a longitudinal length dimension that is substantially longer than its latitudinal width dimension. A "patch," by contrast, may have substantially equivalent longitudinal and latitudinal lengths and may have uniform or various non-uniform shapes. Various shapes and sizes of stripes and patches are contemplated herein. However, while a stripe or patch may extend to the edge of a fibrous sheet material or a resulting document, in a preferred embodiment, the stripe or patch is located within the perimeter of the fibrous sheet material or document and does not extend to the edge of the sheet material or document.

As noted, various sizes of security devices are contemplated as suitable for the inventive method and fibrous sheet material. In one embodiment, the size ranges from about 5 to about 75 millimeters (mm), preferably from about 15 mm to about 40 mm in total length and; from about 2 mm to about 50 mm, preferably from about 6 mm to about 25 mm in total width; and from about 10 to about 50 microns, preferably from about 15 microns to about 40 microns in total thickness. All ranges noted herein include all subranges, including integers and fractions.

As noted, various shapes are also contemplated for the security devices; for example, patches, stripes, or threads, geometric shapes such as stars, parallelograms, polygonal (e.g., hexagons, octagons, etc.) shapes, numbers, letters and various symbols. Simple and complex non-geometric designs are also contemplated as suitable. These shapes and designs can be cut with a rotary die process.

In one embodiment of the inventive method, the security device is introduced into the forming fibrous web such that it is in register with at least one other feature on or in the substrate of the fibrous web, the fibrous sheet material or the resulting document. In certain embodiments, the security device is introduced such that a particular feature within the security device is in register with another feature in the fibrous web, the resulting fibrous sheet material or document. The at least one other feature can be varied as necessary relative to the application. For example, the at least one other feature is a watermark, a printed image, a relief structure, another security device, or a paper-borne feature. In introducing the security device to the fibrous web such that it is in register, it is contemplated that the security device, first presented in the form of a continuous web, is delivered to a piece of equipment or system (referred to herein as the intro-device) that can be used to cut/punch the continuous web into discontinuous security devices. While it is possible to use a separate device to cut then apply the security device to the fibrous web, it is preferred that the system used for forming the discontinuous security devices is also used for applying the security devices into or onto the fibrous web. With a single device, it is possible to more precisely apply the security device in register since it requires less moving parts.

In the preferred embodiment wherein the continuous web is cut into discontinuous security devices that are then introduced into or onto the fibrous web by the same intro-device, it is also contemplated that the placement of the security device is adjustable by the intro-device such that a mis-registered (misaligned with the at least one other feature) security device can be adjusted in a continuous manner to be in register. By using a single intro-device to cut, apply and adjust registration in situ with the paper manufacturing process, additional processing to adjust the placement is rendered unnecessary. For example, the registered application and adjustment during the paper manufacturing process eliminates the need for secondary processing of the resulting sheet material or document prior to printing.

Suitable intro-devices will be apparent to those of ordinary skill in hindsight of the instant disclosure. However, in a preferred embodiment, the intro-device is a system that employs either an optical or a fiber-density sensor that checks the registration between the security device and the at least one other feature in the fibrous web, the fibrous material or the resulting document. In view of the identified or calculated location of the security device or the relative locations of the security device and the at least one other feature, the intro-device is used to make adjustments in the placement of the security device. To make such adjustments the intro-device uses a variable speed advancing device (e.g., electric servomechanism with servo drive) that controls the tension on the continuous web such that the discontinuous security device can be applied in register as desired. The point of introduction of the security device is thereby continuously adjusted by modulating a tension on the continuous web. Alternatively, the intro-device may be a rotary die cut and transfer device such as that used in the label industry to apply labels in registration.

In another aspect of the invention, a fibrous sheet material is provided. The fibrous sheet material as described herein results from further processing of the fibrous web after the security device has been introduced thereto. Said further processing optionally includes a drying step that is applied before or after pressing the security device into the fibrous web. The pressing of the security device into the fibrous web produces a fibrous sheet material having a fibrous bulk-region and a fibrous sub-region.

The resulting fibrous sheet material, which has opposing surfaces and a recess in one opposing surface, comprises: a surface applied security device disposed in the recess; a fibrous sub-region disposed beneath the recess; a fibrous bulk-region disposed next to the security device (disposed in the recess) and the sub-region; and an interface between the security device and at least one surface of the fibrous sheet material. As used herein, reference to a bulk-region being next to the security device indicates that in a cross-sectional view the bulk-region is the region adjacent to the security device along the x-axis. As used herein, reference to a sub-region being beneath the security device indicates that in a cross-sectional view the sub-region is the region along the y-axis that at least part of the security device covers. The sub-region has a thickness that is less than the thickness of the bulk-region such that the surface applied security device has a caliper differential that is less than 80% of the thickness of the security device or as described above in the specified ranges and implied subranges.

In one embodiment, fibers in the sub-region are further consolidated such that the amount of fibers in the sub-region is substantially equivalent to fibers in at least the immediate adjoining bulk-region. In one other embodiment, the amount of fibers in the sub-region is substantially equivalent to the amount of fibers in the bulk-region. As used herein, the term "substantially equivalent", as reference to the amount of fibers in the bulk- and sub-regions, means that the amount of fibers in each region are within 80% to 100% of the amount in the other; preferably 90% to 100% as characterized by the grams per square meter (gsm) of fibers. In a preferred embodiment, the amount of fibers in the sub-region is equivalent to an amount ranging from 80% to about 100% of the bulk-region; particularly the immediate adjoining bulk-region.

As noted herein, various thicknesses may be attributed to a suitable security device. Consequently, various caliper differentials are also contemplated. In one embodiment of the fibrous sheet material, the security device has a thickness ranging from about 10 to about 75 microns. The caliper differential range from about −10 to about 30 microns; preferably from 0 to about 25 microns; preferably from about 0 to about 15 μm.

In one embodiment, the fibrous sheet material demonstrates at least one of (1) improved durability, (2) acceptable ink adhesion, (3) high cross-direction (CD) tensile strength, or (4) reduced backside show-through. As used herein, improved durability is characterized by at least one of (a) minimal or reduced damage at the interface when compared to such sheet materials that are produced when the fibrous web is not sufficiently consolidated or (b) almost no hinge effect. These effects can be quantified or qualified by known industry techniques that simulate the effects of circulation of the documents. For example, the circulation of a banknote can be simulated with a durability test. One such suitable durability test is the "Circulation Simulation" Test (CST). This is a wear and tear test designed to approximate the mechanical and optical degradation experienced by a banknote through its circulation lifecycle. This test is performed by attaching rubber grommets, each weighing 7.5 grams, to the four corners of a banknote, and then placing the weighted banknote in a rock tumbler at a speed calibrated to 60 revolutions per minute (RPM) for a fixed duration of 30 minutes (one (1) cycle). The tumbling action experienced by the weighted banknote induces mechanical and optical degradation. Controlled amounts of liquid and solid soiling agents (e.g., soybean oil and clay) are then added to the rock tumbler to simulate the influence of oils and dirt which a banknote would typically come in contact with during its lifecycle. The banknote is tested before and after each round of simulated degradation for mechanical deterioration (e.g., surface and edge damage in the form of holes, tears, cuts, hinges, separated parts and ragged uneven edges, loss of tensile strength, fold endurance, tear resistance, and perforation resistance), optical deterioration (e.g., deterioration in printing ink color properties) and soiling. Hinge effects and tearing at the interface are examples of mechanical degradation that are particularly suited for this durability test.

Figure 12:
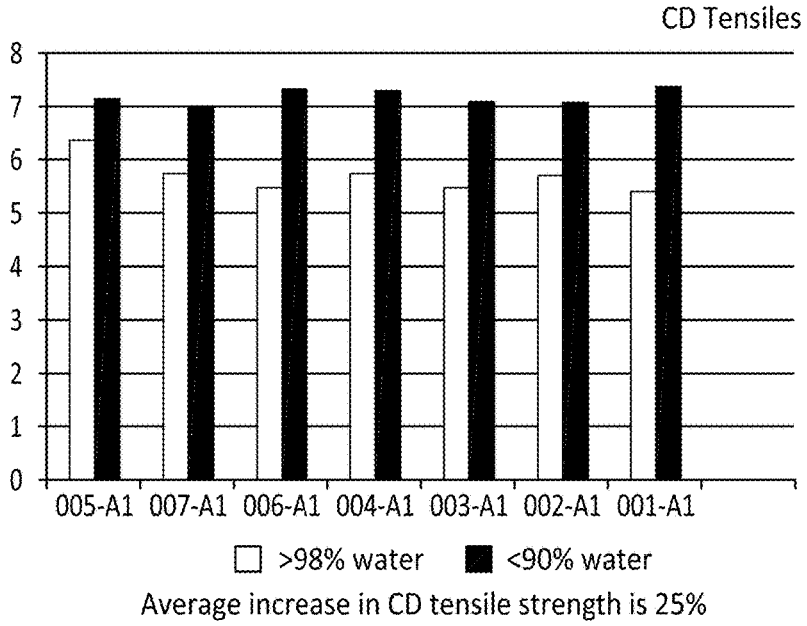
FIG. 12 is a bar graph marked "Table 2", which illustrates cross-directional tensile strength values of an exemplary embodiment of the present invention as compared to a comparative example.

Tests for acceptable ink adhesions are known to those of ordinary skill in the art. For example, ink set-off, which is the amount of ink that is transferred from one sheet to another in a stacked formation of multiple fibrous sheet materials or documents, can be quantitatively measured by methods known to those of ordinary skill in the art. Similarly, tensile strength and backside show-through can be quantified by methods known to those of ordinary skill in the art. For instance, show-through can be quantified by known light reflectance or transmittance tests. In CD tensile strength tests using, for example, an INSTRON® tension tester, or pull tester, and as shown in FIG. 12 herein below, papers made in accordance with the present invention demonstrated an increase in CD tensile strength, with the tested property having an increased value ranging from about 90% to about 100%, when compared to conventional cylinder application of the security device to a fully formed fibrous web.

The fibrous sheet material, as noted, has a fibrous sub-region beneath the security device and a fibrous bulk-region next to the security device and sub-region. Because the security device was introduced when the fibrous web was sufficiently consolidated, the fibers in the region of the fibrous web which corresponds to the sub-region in the sheet material were not displaced in an amount that results in the identified disadvantages. As such, the amount of fibers in the fibrous sub-region is substantially equivalent to the amount of fibers in at least the immediate adjoining bulk-region. As used herein, the term "immediate adjoining bulk-region" refers to a region in the bulk region that abuts the sub-region and the recessed portion of the security device. This immediate adjoining bulk region extends radially from the recessed portion and the sub-region to a distance in the cross-sectional x-axis that is equivalent to the x-axis length of the sub-region. In view of the volume difference between the immediate adjoining bulk-region and the sub-region, the density of fibers in the sub-region is greater than the density of fibers in the immediate adjoining bulk region. The amount of fibers in the immediate bulk-region and sub-region are substantially equivalent such that given the difference in volume of the two regions, the density in the sub-region is greater than the density in the immediate adjoining bulk-region. In one exemplary embodiment, the amount of fibers in the bulk region ranges from 88.55 gsm to 90.15 gsm, while the amount of fibers in the sub-region ranges from 87.26 gsm to 90.69 gsm. As used herein, "density" refers to the average amount of fibers in a volume.

As noted herein, security devices suitable for the present invention are numerous. However, in one embodiment, the fibrous sheet material comprises a security device having an array of cylindrical and/or non-cylindrical focusing elements, and an array of image icons that optically interact with the focusing elements to produce at least one synthetic image. In preferred embodiments the focusing elements are exclusively either cylindrical lenses or non-cylindrical lenses (e.g., micro-lenses). However, it is contemplated herein that the array of lenses comprises a blend of both in various ratios.

As noted herein, the security device can be in the form of stripe or patch or other shapes or geometries. In one embodiment the security device is present in the sheet material in register with at least one other feature in the sheet material. Suitable other features are described herein.

In another aspect, the invention is a document comprising the fibrous sheet material. Various documents are contemplated by the present invention. For example, suitable documents include, but are not limited to, banknotes, bonds, checks, traveler's checks, identification cards, lottery tickets, passports, postage stamps, stock certificates, as well as non-security documents such as stationery items and labels and items used for aesthetics. A plurality of security devices may be introduced into the fibrous web and consequently a plurality of security devices can be found applied to the fibrous sheet material and any resulting document. Alternatively, in one embodiment, the document comprises at least one surface applied security device and at least one other security device such as an embedded or partially embedded security device or security feature. The surface applied security device can be in register with other features of the document such as other security devices or security or decorative features.

Fibrous sheet materials suitable for use in the present invention are paper or paper-like sheet materials. These sheet materials, which are single or multi-ply sheet materials, may be made from a range of fiber types including synthetic or natural fibers or a mixture of both. For example, these sheet materials may be made from fibers such as abaca, cotton, linen, wood pulp, and blends thereof. As is well known to those skilled in the art, cotton and cotton/linen or cotton/synthetic fiber blends are preferred for banknotes, while wood pulp is commonly used in non-banknote security documents.

As noted above, security devices contemplated for use with the present invention may take a number of different forms including, but not limited to, stripes, bands, threads, ribbons, or patches (e.g., micro-lens based, holographic and/or color shift security threads).

Further understanding of the claimed invention will be aided by the following description of figures that represent exemplary embodiments.

Figure 2:
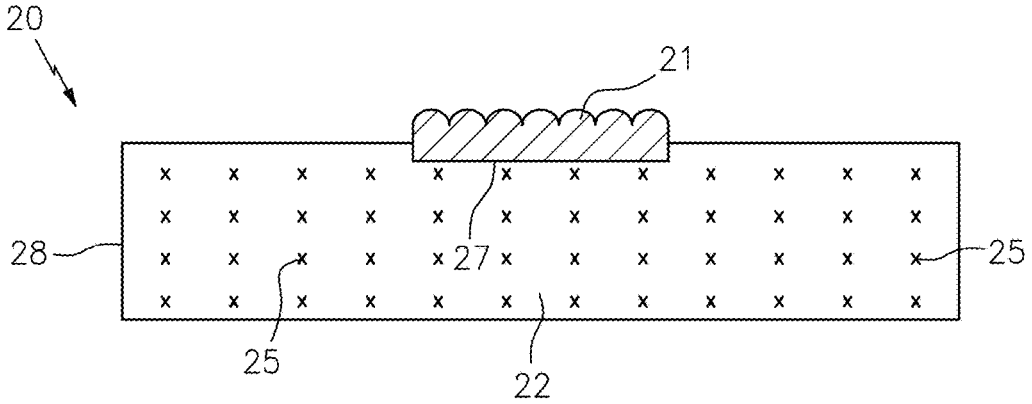
FIG. 2 (PRIOR ART)
FIG. 2 is a cross-sectional side view of a fibrous sheet material produced by introducing the security device onto a fibrous web during or after a dry stage of paper manufacturing when the moisture content is too low to allow pressing of the security device into the substrate to further consolidate the fibers.

Conventional techniques are depicted in FIG. 1 and FIG. 2. Generally, as shown in FIG. 1, the security device (11) is introduced in the wet stage of paper manufacturing to embed device (11) in a fibrous sheet material or document (10). When this method is used to surface apply the security device, the resulting fibrous sheet material suffers from low circulation durability, poor CD tensile strength and high backside show-through. As mentioned elsewhere herein, this has been discovered to be due in part to the displacement of fibers (15) from sub-region (12) when the security device (11) is introduced to the forming fibrous web. As can be seen, the amount of fibers in hinge area (14) is significantly reduced. This results in weak interactions at interface (17) between the security device and the substrate (18) of the fibrous sheet material or document (10). This is especially evident at interfacial edges (17*a*).

Disadvantages are also found in the conventional embodiment shown in FIG. 2, where security device (21) is introduced in a dry stage of paper manufacturing or after paper manufacturing when the paper is fully consolidated. Here, fibers (25) in sub-region (22) are so fully consolidated such that the security device (21) cannot be pressed into the substrate (28). As a result, the caliper differential is high. High caliper differential has been associated with poor ink application to the sheet material or document (20). As a consequence, for embodiments where the security device is added in a dry stage, the security device must be very thin in order to have a suitable caliper differential.

Figure 3:
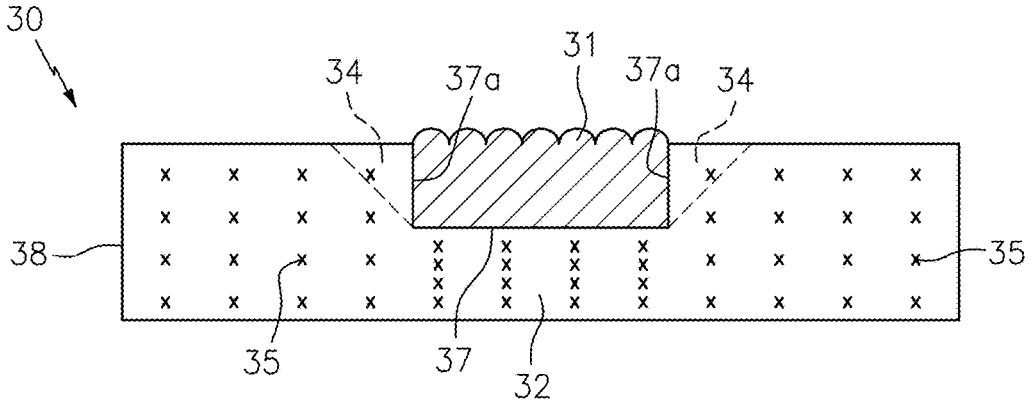
FIG. 3 is a cross-sectional side view of an exemplary embodiment of the fibrous sheet material of the present invention with its surface applied security device, where the security device is introduced into or onto the fibrous web when the fibrous web was sufficiently consolidated.

At least one of these disadvantages is addressed by the present invention. FIG. 3 depicts one embodiment of the present invention. Here, unlike in FIG. 1 and FIG. 2, the security device (31) is introduced in a wet stage when the fibrous web is sufficiently consolidated such that a substantial amount of fibers (35) are not displaced from the sub-region (32) when the security device is pressed into the substrate (38) of the fibrous sheet material (30). Rather, the fibers (35) are further consolidated or densified under the security device (31) and in the hinge area (34). This results in strong fiber interactions at the interface (37) and particularly at the interfacial edges (37*a*). Moreover, since the security device (31) is introduced during the wet stage, it can be pressed into the substrate (38) to provide a low caliper differential.

Figure 4:
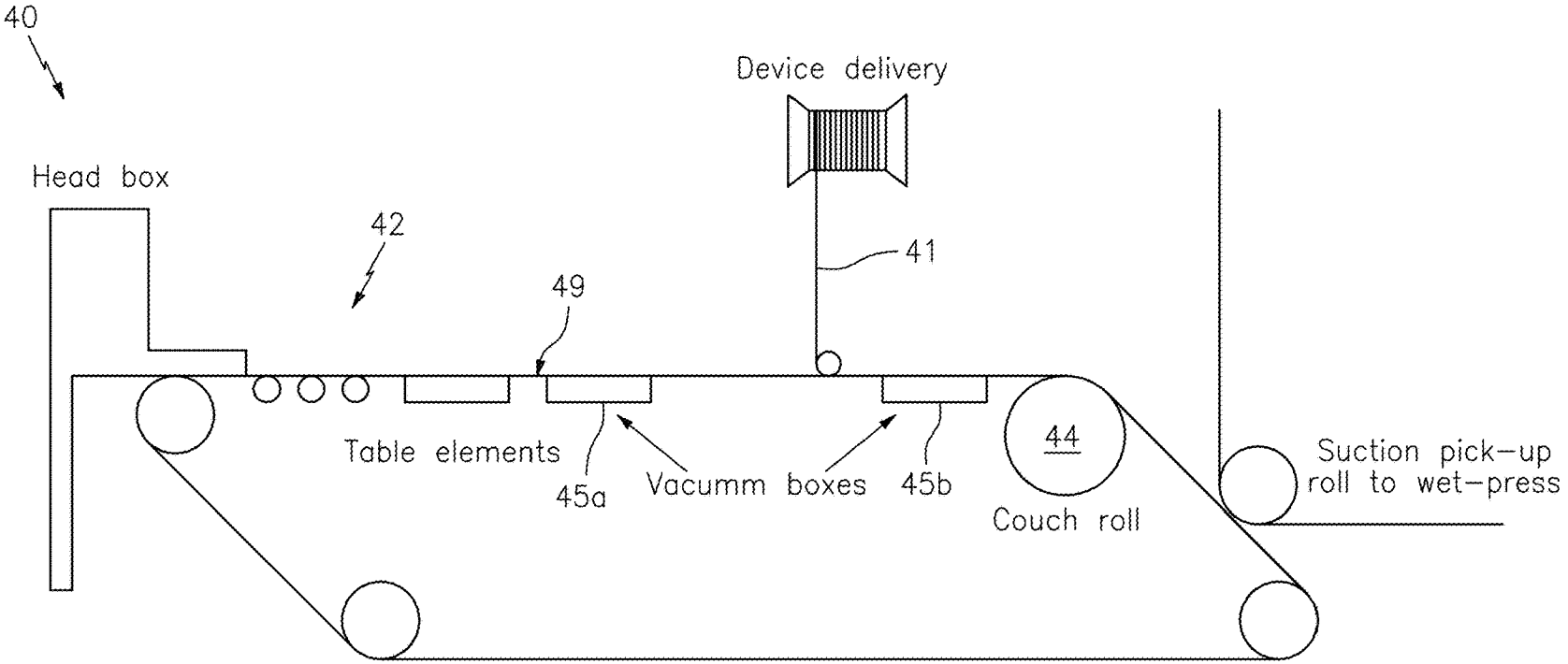
FIG. 4 is a schematic diagram of a Fourdrinier paper machine where the security device, in the form of a continuous web, is introduced to a forming fibrous web on a wire after the wet line and before the couch roll.

The security device (41) may be introduced to the fibrous web (49) using various methods and techniques. In a preferred embodiment, which is shown in FIG. 4, the security device (41) is presented in the form of a continuous web (41) and is continuously applied to the forming fibrous web (49) on a Fourdrinier paper machine (40) directly after the wet line (42) and before couch roll (44), and between vacuum boxes (45*a*, 45*b*), which help set the security device into the fibrous web (49).

Figure 6:
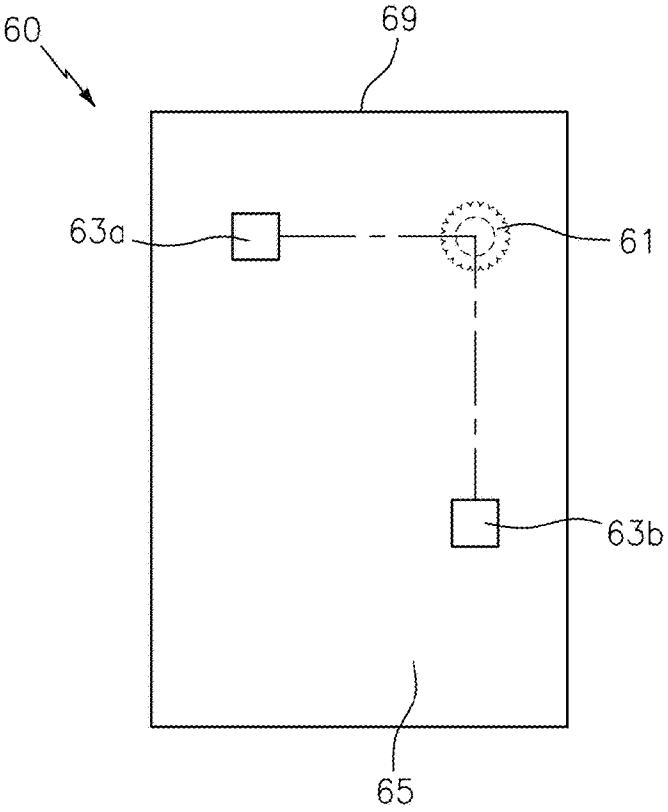
FIG. 6 is a top plan view of another exemplary embodiment of a document in accordance with the present invention which has a plurality of discontinuous surface applied security devices (patches) that are applied in register with another feature in the document, such as a watermark.
Figure 5:
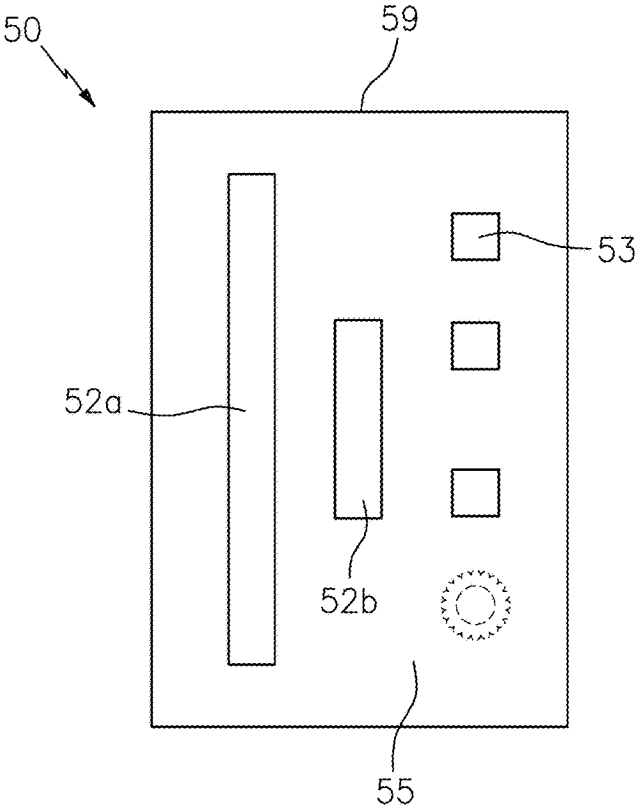
FIG. 5 is a top plan view of an exemplary embodiment of a document in accordance with the present invention which has a plurality of discontinuous surface applied security devices (patches and stripes) applied thereto.

FIGS. 5 and 6 depict fibrous sheet materials or resulting documents (50, 60) of the subject invention having a plurality of surface applied security devices (52*a*, 52*b*, 53, 63*a*, 63*b*). The devices (52*a*, 52*b*, 53, 63*a*, 63*b*) are presented here in the form of patches (53, 63*a*, 63*b*) and stripes (52*a*, 52*b*) of different sizes and shapes. While not so limited in terms of location of placement of the security device (52*a*, 52*b*, 53, 63*a*, 63*b*), in one embodiment of the present invention, the security devices (e.g., 53, 63*a*, 63*b*) are cut or punched and applied by an intro-device (not shown) to the fibrous web (55) during paper manufacturing such that it is in register with at least one other feature (e.g., watermark (61)) in the fibrous web, the fibrous sheet material or a resulting document (60). FIG. 6 depicts the embodiment where a plurality of security devices applied as patches (63*a*, 63*b*), are applied in register with a watermark (61). A first patch (63*a*) is applied in latitudinal registration with the watermark (61), while a second patch (63*b*) is applied in longitudinal registration with the watermark (61). It is also contemplated that the security device (63*a*, 63*b*) is aligned with the watermark (61) such that at least one feature (not shown) in the patch (63*a*, 63*b*) is in register with the watermark (61) or other feature in the fibrous web, fibrous sheet material or resulting document (60). The document (50, 60) has edges (59, 69) which, although depicted here as a side of a parallelogram, may also be depicted in other shapes with other angles. The security devices (52*a*, 52*b*, 53, 63*a*, 63*b*) are applied to the fibrous web, fibrous sheet material or document such that it does not extend beyond the edge (59, 69) of the document (50, 60). In a preferred embodiment, the security device is disposed on the surface such that it is situated away from the edge, not touching.

EXAMPLES

Figure 7A:
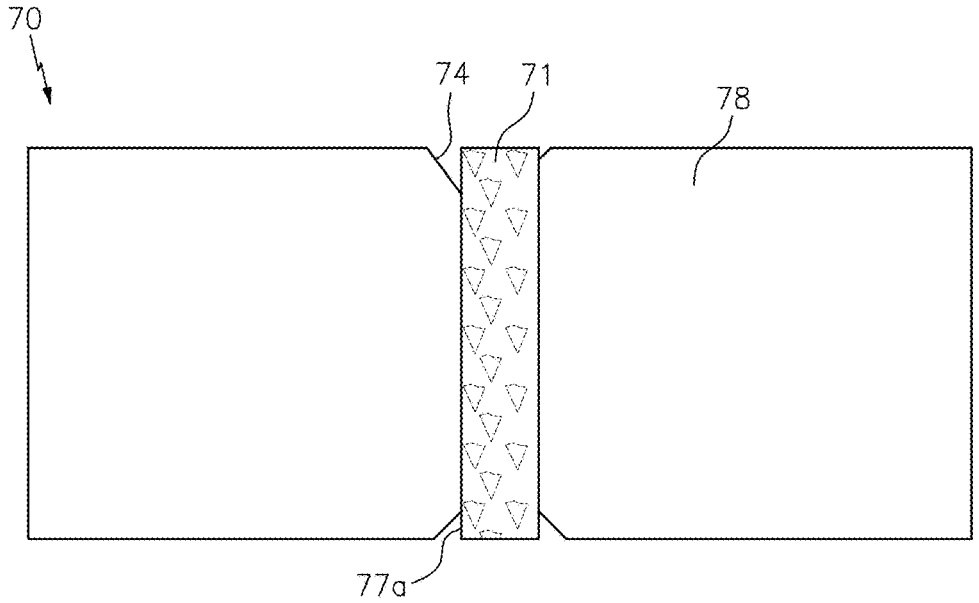
FIG. 7*a* is a plan view of the front side of a fibrous sheet material or document, produced by introducing the security device to a forming fibrous web during a wet stage of the paper manufacturing when the fibrous web is not sufficiently consolidated, after the fibrous sheet material or document has been subjected to one (1) cycle through a Circulation Simulation Test.

Comparative Example 1: Single Cycle Durability Test of Surface Applied Security Device when the Fibrous Web is not Sufficiently Consolidated In a first comparative example, a fibrous sheet material is made according to the conventional wet stage process where the security device is introduced to a fibrous web during the paper manufacturing process when the water and/or moisture content of the fibrous web is greater than 98%. As a result of fiber displacement, fibers in the hinge area (74) and in the sub-region are displaced resulting in decreased interaction of the security device (71) and the fibrous substrate (78) of the fibrous sheet material (70) in those areas. The fibrous sheet material (70) formed according to this process is depicted in FIG. 7*a*, after a single cycle (30 min.) through the Circulation Simulation Test. As a result of this single cycle, the fibrous sheet material (70) demonstrated poor durability, at least as defined by the development of a hinge effect as shown in hinge area (74). The security device (71) is detached from the substrate (78) of the fibrous sheet material (70) at points along the interfacial edges (77*a*).

Figure 7B:
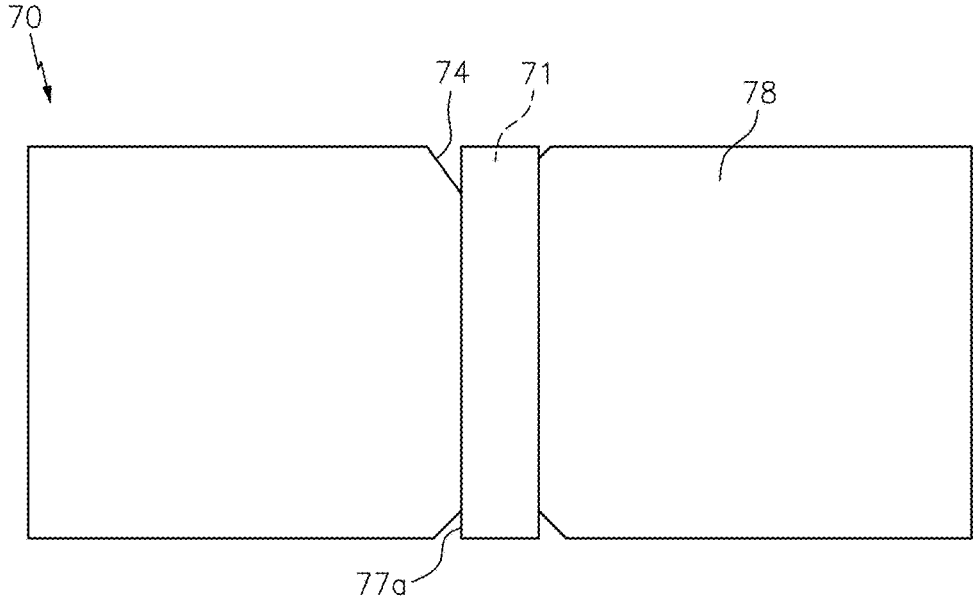
FIG. 7*b* is a plan view of the backside of a fibrous sheet material or document, produced by introducing the security device to the fibrous web during a wet stage of the paper manufacturing when the fibrous web is not sufficiently consolidated, after it has been subjected to one (1) cycle through a Circulation Simulation Test and show.

Moreover, the surface applied security device demonstrated backside show-through. A panel of five (5) persons (P1, P2, P3, P4, P5) were asked to rate the degree of backside show-through from 1 to 5, with 5 having the highest show-through and 1 having the least show-through. Panelists P1 and P4 rated the backside show-through as 4; panelist P2, P3 and P5 rated the backside show-through as 5. FIG. 7*b* depicts a fibrous sheet material (70) showing the backside show-through. This would require some kind of a backside camouflage coating to address this problem.

Cross-directional (CD) tensile strength of the fibrous sheet material was also measured using an INSTRON® tension tester, model 5965. A paper sample is cut to a dimension of 125 mm wide by 15 mm high with the thread running vertically through the center of the sample. The sample is then placed in the jaws of the Instron (model 5965) tensile tester with the jaws at a set with a 40 mm spacing between them and the thread centered in the gap. The sample is then elongated at a rate of 38 mm/minute until the sample breaks. This process is repeated 5 times and the average of the 5 values is the reported result of the test. The results showed that the CD tensile strength ranged from 5.4 to 6.3 kg.

Figure 8A:
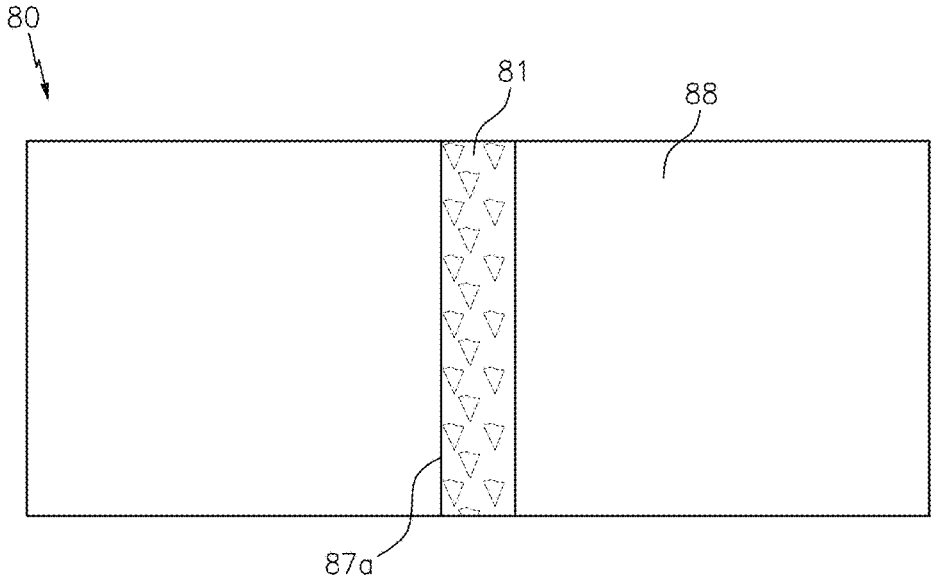
FIG. 8*a* is a plan view of the front side of an exemplary embodiment of a fibrous sheet material or document in accordance with the present invention, produced by introducing the security device to a forming fibrous web during a wet stage of the paper manufacturing when the fibrous web is sufficiently consolidated, after the fibrous sheet material or document has been subjected to one (1) cycle through a Circulation Simulation Test.

Inventive Example 1: Single Cycle Durability Test of Surface Applied Security Device when the Fibrous Web is Sufficiently Consolidated In a first inventive example, a fibrous sheet material (80) is made according to the invention disclosed herein where the security device (81) is introduced to a fibrous web during the paper manufacturing process when the moisture content of the fibrous web is less than 98%. As a result of reduced fiber displacement from the hinge area and increased fiber consolidation in the sub-region, there is sufficient interaction of the security device (81) with the substrate (88) of the fibrous sheet material (80). The fibrous sheet material (80) formed according to this process is depicted in FIG. 8*a*, after a single cycle through the Circulation Simulation Test. As is evident, the fibrous sheet material (80) has improved durability, relative to that produced in comparative example 1. Here, the fibrous sheet material (80) shows no hinge effect and no damage or separation along the interfacial edge (87*a*) of the security device (81) and the substrate (88) of the fibrous sheet material (80). The fibrous sheet material (80) remains intact, demonstrating improved durability.

Figure 8B:
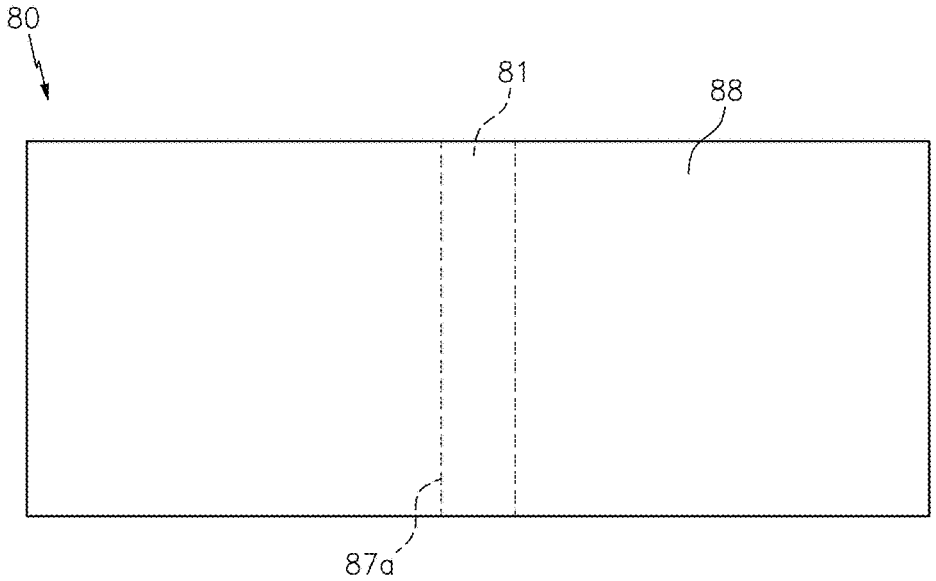
FIG. 8*b* is a plan view of the backside of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to one (1) cycle through a Circulation Simulation Test.
Figure 11:
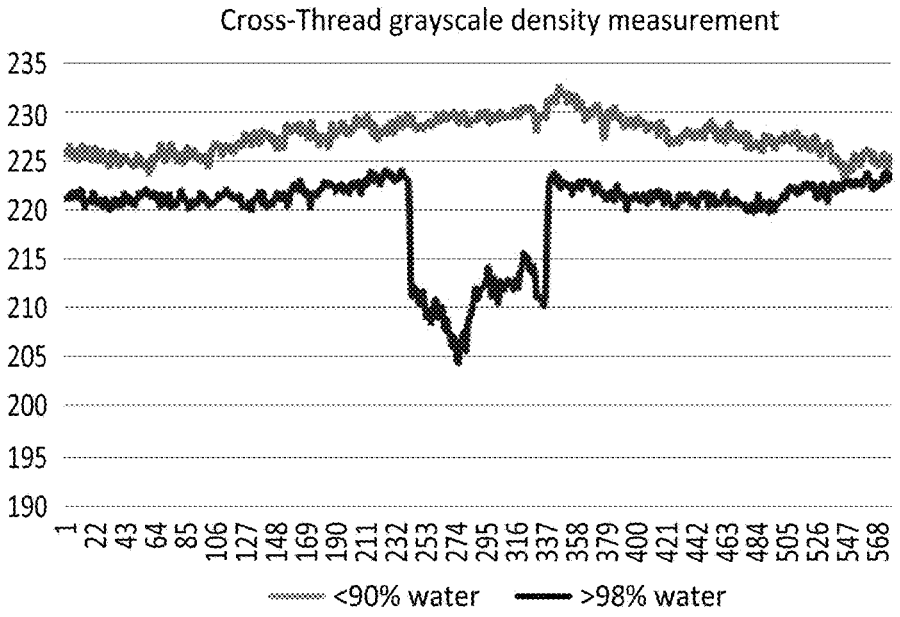
FIG. 11 is a graph marked "Table 1", which illustrates cross-thread grayscale density measurements of an exemplary embodiment of the present invention as compared to a comparative example.

Moreover, the surface applied security device (81) demonstrated less backside show-through compared to comparative example 1. A panel of five (5) persons (P1, P2, P3, P4, P5) were asked to rate the degree of backside show-through from 1 to 5, with 5 having the highest show-through and 1 having the least show-through. Panelist P2 rated the backside show-through as 1; panelist P1, P3, P4 and P5 rated the backside show-through as 2. FIG. 8*b* depicts a fibrous sheet material showing the backside show-through. Alternatively, the backside show-through was characterized by measurement of cross-thread grayscale density. The paper sample was scanned on an Epson V750 perfection flatbed scanner which had been calibrated using an IT8 reference target. The paper was scanned at 600 dpi as a greyscale image in reflected light with a black background behind the sample. Once the scan is captured, a selected area density profile was generated. With this function, we select a region spanning the thread, where software captures the greyscale value for every pixel in the selected region, for this particular test, with the thread running vertically through the center of the selected region, the software averages the vertical pixels within the region and reports the vertical average data point for every horizontal pixel (e.g., if the region is 20 pixels high by 200 pixels wide, then for each horizontal position, the corresponding vertical pixel values would be averaged and would result in an output of 200 data points). The resulting data is then plotted in graph to show if there is any noticeable displacement in the greyscale values within the sampled area. The results of the density measurements are provided in FIG. 11. The results of the inventive example are provided by the top line while the results of the comparative example are provided in the lower line, indicating a substantial dip in the fiber density measurement as the measurement device traverses the opposing side of the security device. Lower values indicate high backside show-through. As can be seen, with the inventive method (<90% water and/or moisture), the density values across the fibrous sheet material remain relatively constant while for the comparative examples (>98% water and/or moisture), the density values take a recognized and substantial decrease in values. The mean cross-thread grayscale density for the comparative examples (>98% water) is 214; while the mean cross-thread grayscale density for the inventive examples (<90% water) is 226.

Cross-directional (CD) tensile strength of the fibrous sheet material (80) was also measured using an INSTRON® tension tester, model 5965. The same process as above was repeated here. The results showed that the CD tensile strength was better than that demonstrated in comparative example 1. Results of the comparative example are depicted as the first bars (>98% water) in FIG. 12, while results of the inventive example (<90% water) are depicted as the second bars in FIG. 12.

Figure 9A:
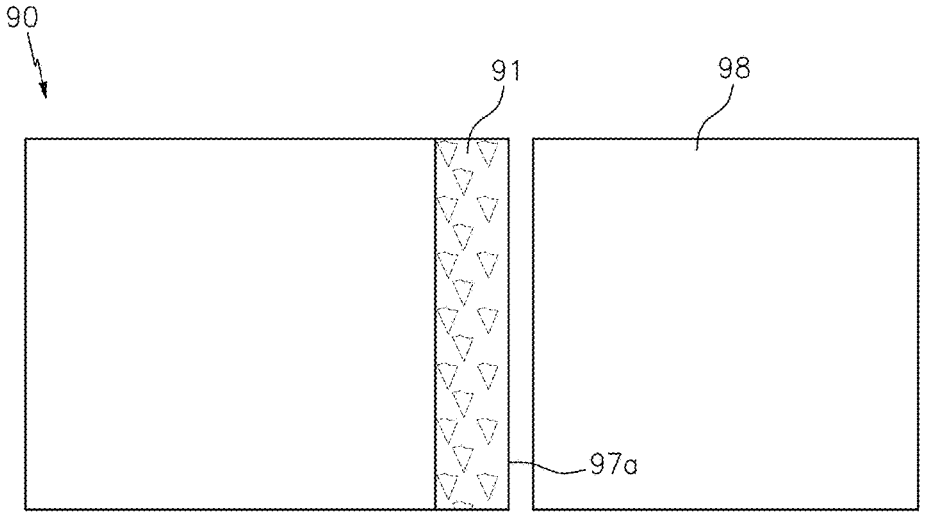
FIG. 9*a* is a plan view of the front side of a fibrous sheet material or document, produced by introducing the security device to a forming fibrous web during a wet stage of the paper manufacturing when the fibrous web is not sufficiently consolidated, after the fibrous sheet material or document has been subjected to three (3) cycles through a Circulation Simulation Test.

Comparative Example 2: Three Cycle Durability Test of Surface Applied Security Device when the Fibrous Web is not Sufficiently Consolidated In a second comparative example, a fibrous sheet material (90) is made according to the conventional wet stage process where the security device is introduced to a fibrous web during the paper manufacturing process when the moisture content of the fibrous web is greater than 98%. As a result of fiber displacement, fibers in the hinge area and in the sub-region are displaced during introduction of the security device (91) resulting in decreased interaction of the security device (91) and the substrate (98) of the fibrous sheet material (90) in those areas. The fibrous sheet material (90) formed according to this process is depicted in FIG. 9*a*, after three cycles through the Circulation Simulation Test. As a result of these three cycles, the fibrous sheet material (90) demonstrated poor durability, at least as defined by the development of a tear in the sheet material along interfacial edge (97*a*). The fibrous sheet material (90) is torn in two pieces along the interfacial edge (97*a*).

Figure 9B:
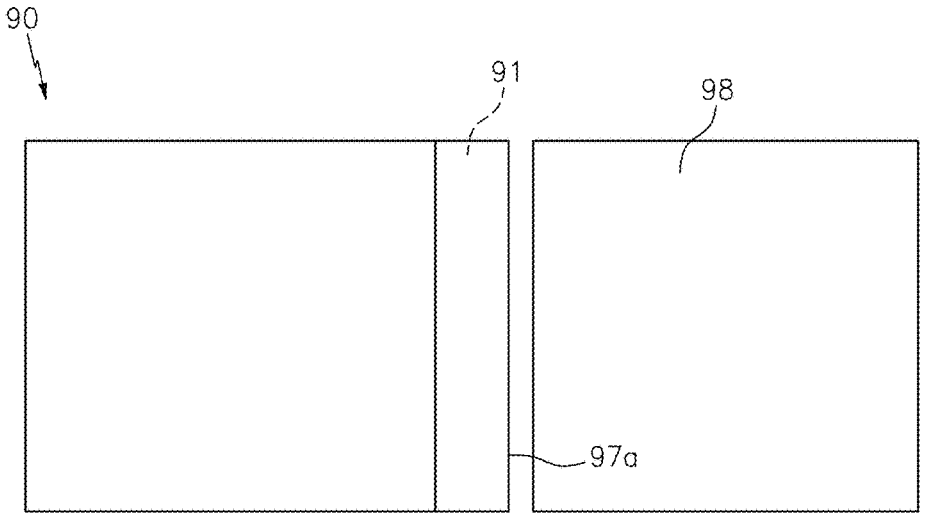
FIG. 9*b* is a plan view of the backside of a fibrous sheet material or document, produced by introducing the security device to a forming fibrous web during a wet stage of the paper manufacturing when the fibrous web is not sufficiently consolidated, after the fibrous sheet material or document has been subjected to three (3) cycles through a Circulation Simulation Test.

Moreover, the surface applied security device (91) demonstrated backside show-through. A panel of five (5) persons (P1, P2, P3, P4, P5) were asked to rate the degree of backside show-through from 1 to 5, with 5 having the highest show-through and 1 having the least show-through. Panelists P1 and P5 rated the backside show-through as 5; panelist P2, P3 and P4 rated the backside show-through as 4. FIG. 9*b* depicts a fibrous sheet material (90) showing the tear and backside show-through. This would require some kind of a backside camouflage coating to address this problem.

Figure 10A:
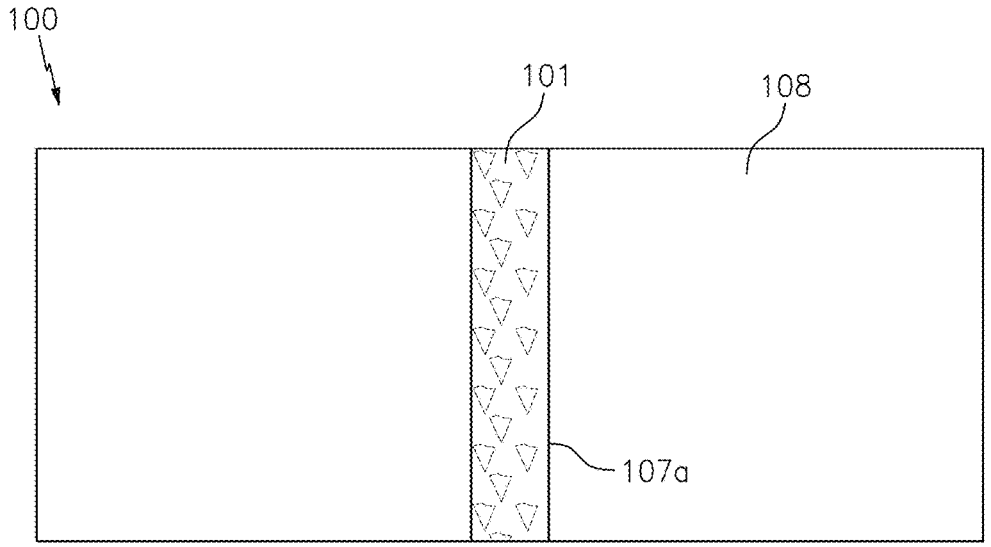
FIG. 10*a* is a plan view of the front side of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to three (3) cycles through a Circulation Simulation Test.

Inventive Example 2: Three Cycle Durability Test of Surface Applied Security Device when the Fibrous Web is Sufficiently Consolidated In a second inventive example, a fibrous sheet material (100) is made according to the invention disclosed herein where the security device (101) is introduced to a fibrous web during the paper manufacturing process when the moisture content of the fibrous web is less than 98%. As a result of reduced fiber displacement from the hinge area and increased fiber consolidation in the sub-region, relative to that in comparative example 1, there is sufficient interaction of the security device with the substrate (108) of the fibrous sheet material (100). The fibrous sheet material (100) formed according to this process is depicted in FIG. 10*a*, after three cycles through the Circulation Simulation Test. As is evident, the fibrous sheet material (100) has improved durability, relative to that produced in comparative example 2. Here, the fibrous sheet material (100) shows little to no hinge effect or damage along the interfacial edge (107*a*) of the security device (101) and the substrate (108) of the fibrous sheet material (100). The fibrous sheet material (100) remains intact, demonstrating improved durability.

Figure 10B:
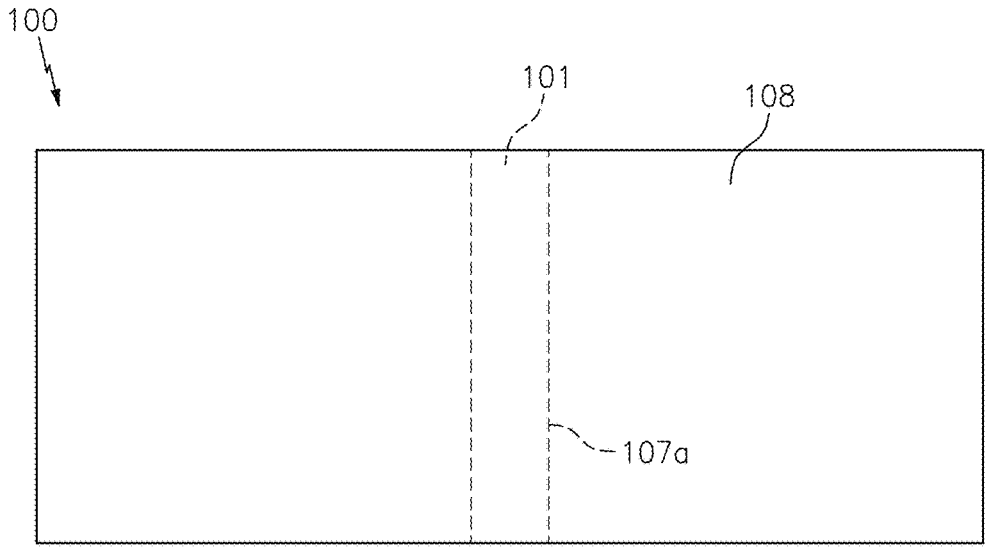
FIG. 10*b* is a plan view of the backside of an exemplary embodiment of a fibrous sheet material or document in accordance with the present invention, produced by introducing the security device to the fibrous web during a wet stage of the paper manufacturing when the fibrous web is sufficiently consolidated, after the fibrous sheet material or document has been subjected to three (3) cycles through a Circulation Simulation Test.

Moreover, the surface applied security device (101) demonstrated less backside show-through compared to comparative example 2. A panel of five (5) persons (P1, P2, P3, P4, P5) were asked to rate the degree of backside show-through from 1 to 5, with 5 having the highest show-through and 1 having the least show-through. Panelist P1 rated the backside show-through as 2; P2, P4 and P5 rated the backside show-through as 1; and panelist P3 rated the backside show-through as 3. FIG. 10*b* depicts a fibrous sheet material showing the improved backside show-through.

While various embodiments of the present invention have been described above it should be understood that they have been presented by way of example only, and not limitation. Thus, the breadth and scope of the present invention should not be limited by any of the exemplary embodiments.

The invention claimed is:

1. A fibrous sheet material having opposing surfaces and a recess in one opposing surface, which comprises:

a fibrous sub-region disposed beneath the recess, and an immediate adjoining bulk-region disposed next to the recess and the sub-region;

a surface applied security device disposed in the recess; and an interface between the surface applied security device and the one opposing surface, wherein the surface applied security device has been introduced during a wet stage of a paper manufacturing process where a fibrous web was sufficiently consolidated as a fully formed wet web, wherein by introducing the security device at this wet stage of the paper manufacturing process, the security device has been adequately forced into the fibrous web to further consolidate fibers in the sub-region rather than displacing them, wherein a water level and/or a moisture level of the sufficiently consolidated fibrous web ranged from about 60% to about 90% by weight, based on a total weight of the fibrous web, when the surface applied security device was introduced.

2. The fibrous sheet material of claim 1, wherein the security device has a thickness ranging from about 10 to about 75 microns.

3. The fibrous sheet material of claim 1, wherein the fibrous sheet material demonstrates at least one of (a) improved durability characterized by at least one of minimal damage at the interface, or almost no hinge effect, when subjected to at least one durability test cycle, or (b) acceptable ink adhesion, or (c) improved CD tensile strength, or (d) minimal or no show-through.

4. The fibrous sheet material of claim 1, wherein an amount of fibers in the fibrous sub-region are substantially equivalent to the mount of fibers in a bulk-region disposed next to the recess and the sub-region.

5. The fibrous sheet material of claim 1, wherein the security device comprises an array of cylindrical or non-cylindrical focusing elements, and an array of image icons that optically interact with the focusing elements to produce at least one synthetic image.

6. A security or value document comprising the fibrous sheet material of claim 1.

7. The security or value document of claim 6, wherein the security device is introduced such that it is in register with at least one other feature on or within the document.

8. The security or value document of claim 7, wherein the at least one other feature on or within the document is selected from the group consisting of a watermark, a printed image, a relief structure, a fiber, or another security device.

9. The security or value document of claim 6, wherein the security or value document is a passport.

10. The security or value document of claim 6, wherein the security or value document is a banknote.

11. The fibrous sheet material of claim 1, wherein the fibrous sheet material is a banknote, and wherein the surface applied security device comprises an array of cylindrical and/or non-cylindrical focusing elements, and an array of image icons that optically interact with the focusing elements to produce at least one synthetic image, wherein a thickness of the fibrous sub-region is less than a thickness of a fibrous bulk-region such that a recess with a sidewall is formed in a surface of the sheet material, wherein the surface applied security device is disposed within the recess, wherein the surface applied security device has a thickness ranging from about 10 to about 40 microns and a caliper differential ranging from about 0 to about 15 microns, and wherein the security device is a stripe or patch exposed on at least one side of the banknote.

12. The fibrous sheet material of claim 1, wherein the surface applied security device has a caliper differential that ranges from about −10 to about 25 microns.

13. The fibrous sheet material of claim 12, wherein the caliper differential ranges from about 0 to about 15 microns.

14. The fibrous sheet material of claim 1, wherein a density of fibers in the fibrous sub-region is greater than the density of fibers in at least the immediate adjoining bulk-region.

15. The fibrous sheet material of claim 1, wherein the security device is in a form of a stripe or patch.

16. The fibrous sheet material of claim 1, wherein the security device is in register with at least one other feature on or within the fibrous sheet material.

17. The fibrous sheet material of claim 16, wherein the at least one other feature on or within the fibrous sheet material is selected from the group consisting of a watermark, a printed image, a relief structure, a fiber or set of fibers, another security device, or combinations thereof.

18. A method for a surface application of a surface applied security device to a fibrous sheet material, comprising:

introducing the security device into or onto a forming fibrous web, at a point of introduction, during paper manufacturing; and wherein the fibrous web is sufficiently consolidated, at least at the point of introduction, such that a water level and/or a moisture level ranges from about 60% to about 90% by weight, based on a total weight of the fibrous web, when the surface applied security device is introduced, and wherein the security device is introduced during a wet stage of the paper manufacturing process where the fibrous web is sufficiently consolidated as a fully formed wet web, wherein by introducing the security device at this wet stage of the paper manufacturing process, the security device is adequately forced into the fibrous web to further consolidate fibers in a sub-region rather than displacing them.

19. The method of claim 18, wherein the security device is first presented as a continuous web that is then cut and placed into or onto the fibrous web.

20. The method of claim 18, further comprising:

providing the security device in a form of a continuous web; and cutting or punching the continuous web in a continuous manner to form patches or stripes, wherein application of the security device comprises continuous introduction of the patches or stripes to the fibrous web such that a fibrous bulk-region, a fibrous sub-region and a negative relief having a sidewall, are formed in the fibrous web.

21. The method of claim 18, wherein the point of introduction of the security device is continuously adjusted by modulating a tension on a continuous web.

22. The method of claim 18, wherein the security device introduced into or onto the fibrous web is in a form of a stripe or patch.

23. The method of claim 18, wherein the security device is introduced such that it is in register with at least one other feature on or within the fibrous sheet material or a document comprising the fibrous sheet material.

24. The method of claim 23, wherein the at least one other feature on or within the fibrous sheet material or document is selected from the group consisting of a watermark, a printed image, a relief structure, a fiber, or another security device.

25. A fibrous sheet material or a document prepared according to the method of claim 18, wherein the fibrous sheet material comprises a surface applied security device.

26. The document of claim 25, wherein the document demonstrates at least one of (a) improved durability characterized by at least one of minimal damage at an interface, or almost no hinge effect, when subjected to at least one durability test cycle, or (b) acceptable ink adhesion, or (c) improved CD tensile strength, or (d) minimal or no show-through.

* * * * *